US011312162B2

(12) United States Patent
Miyakoshi et al.

(10) Patent No.: US 11,312,162 B2
(45) Date of Patent: Apr. 26, 2022

(54) CLEANING DEVICE AND IMAGE FORMING APPARATUS PROVIDED WITH THE CLEANING DEVICE

(71) Applicant: KYOCERA Document Solutions Inc., Osaka (JP)

(72) Inventors: Naoto Miyakoshi, Osaka (JP); Shinobu Ohata, Osaka (JP); Shunsuke Yamasaki, Osaka (JP); Hiroatsu Tamai, Osaka (JP); Yasuhiro Michishita, Osaka (JP); Takeshi Watanabe, Osaka (JP); Kenichi Satake, Osaka (JP); Hiroki Sakane, Osaka (JP); Masato Usui, Osaka (JP); Yuzuru Yuasa, Osaka (JP); Yusuke Tamekuni, Osaka (JP)

(73) Assignee: KYOCERA Document Solutions Inc.

( * ) Notice: Subject to any disclaimer, the term of this patent is extended or adjusted under 35 U.S.C. 154(b) by 187 days.

(21) Appl. No.: 16/885,659

(22) Filed: May 28, 2020

(65) Prior Publication Data

US 2020/0376868 A1 Dec. 3, 2020

(30) Foreign Application Priority Data

May 30, 2019 (JP) ..... JP2019-101696
Sep. 26, 2019 (JP) ..... JP2019-175352

(51) Int. Cl.
*B41J 29/17* (2006.01)
*G03G 21/10* (2006.01)
(Continued)

(52) U.S. Cl.
CPC ..... *B41J 29/17* (2013.01); *B08B 1/008* (2013.01); *G03G 21/10* (2013.01); *G03G 21/169* (2013.01);
(Continued)

(58) Field of Classification Search
CPC ..... B41J 29/17; G03G 21/10; B41F 35/00; B41F 35/02; B41F 35/06; B08B 1/008; B41P 2235/24
See application file for complete search history.

(56) References Cited

U.S. PATENT DOCUMENTS 11,072,194 B2 * 7/2021 Ohata ..... B41J 29/17
11,192,393 B2 * 12/2021 Miyakoshi ..... B41J 29/17
(Continued)

FOREIGN PATENT DOCUMENTS

JP 2004-345805 12/2004
JP 2006-117420 5/2006

*Primary Examiner* — Daniel J Colilla
(74) *Attorney, Agent, or Firm* — Gerald E. Hespos; Michael J. Porco; Matthew T. Hespos

(57) ABSTRACT

A cleaning device includes a cleaning unit and a movement mechanism. The cleaning unit includes: a cleaning part that has a contact surface extending along an axial direction of the conveyance roller and cleans the surface of the conveyance roller by bringing the contact surface into contact with the surface of the conveyance roller from below, and a cleaning housing that supports the cleaning part. The movement mechanism moves the cleaning unit between a cleaning position and a mounting and removing position below the cleaning position. The movement mechanism allows the cleaning part to be brought into contact with the conveyance roller at the cleaning position, allows the cleaning part to be disposed below the conveyance roller in a separated manner at the mounting and removing position and allows the cleaning unit to be mounted on or to be removed from an apparatus body.

13 Claims, 33 Drawing Sheets

(51) Int. Cl.

| | |
|---|---|
| ***B08B 1/04*** | (2006.01) |
| ***G03G 21/16*** | (2006.01) |
| ***B08B 1/00*** | (2006.01) |

(52) U.S. Cl.
CPC ..... *G03G 21/1695* (2013.01); *B41P 2235/24* (2013.01)

(56) References Cited

U.S. PATENT DOCUMENTS

| | | | | |
|---|---|---|---|---|
| 2009/0188529 | A1* | 7/2009 | Maynard | B08B 1/02 134/9 |
| 2010/0232849 | A1* | 9/2010 | Nanataki | G03G 15/2025 399/327 |
| 2017/0113476 | A1* | 4/2017 | Hara | B41J 29/17 |

* cited by examiner

CLEANING DEVICE AND IMAGE FORMING APPARATUS PROVIDED WITH THE CLEANING DEVICE

INCORPORATION BY REFERENCE

This application is based on Japanese Patent Application No. 2019-101696 filed with the Japanese Patent Office on May 30, 2019 and Japanese Patent Application No. 2019-175352 filed with the Japanese Patent Office on Sep. 26, 2019, the contents of which are incorporated by reference.

BACKGROUND

Field of the Invention

The present disclosure relates to a cleaning device and an image forming apparatus provided with the cleaning device.

Related Art

In an image forming apparatus such as a printer, a sheet is conveyed to a predetermined image forming position, and an image is formed on the sheet at the image forming position. Conventionally, there has been known a pair of resist rollers which is used for feeding a sheet to an image forming position. The pair of resist rollers each has a length corresponding to a width of a sheet, and forms a nip portion through which the sheet passes. When a distal end portion of the sheet is brought into contact with the nip portion in a state where the rotation of the pair of resist rollers is stopped, skewing of the sheet is straightened. Then, when the pair of resist rollers is rotated, the sheet is conveyed into the nip portion and, thereafter, the sheet is fed out (conveyed) in accordance with appropriate image forming timing at the image forming position.

Conventionally, there has been known a cleaning device which removes paper dust adhering to a surface of each resist roller. The cleaning device has a web wound in a roll shape, and a pressing roller which presses the web to the surface of the resist roller, and the web is sequentially fed out and hence, a new web surface is brought into contact with the surface of the resist roller so that paper dust is removed.

SUMMARY

A cleaning device according to an aspect of the present disclosure is a cleaning device capable of cleaning a surface of a conveyance roller that is rotatably supported on an apparatus body of an image forming apparatus and is configured to convey a sheet. The cleaning device includes a cleaning unit and a movement mechanism. The cleaning unit includes: a cleaning part that has a contact surface extending along an axial direction of the conveyance roller and cleans the surface of the conveyance roller by bringing the contact surface into contact with the surface of the conveyance roller from below, and a cleaning housing that supports the cleaning part. The movement mechanism is capable of moving the cleaning unit between a cleaning position and a mounting and removing position below the cleaning position. The movement mechanism allows the cleaning part to be brought into contact with the conveyance roller at the cleaning position, allows the cleaning part to be disposed below the conveyance roller in a separated manner at the mounting and removing position, and allows the cleaning unit to be mounted on or to be removed from the apparatus body. The cleaning housing includes: a pair of wall portions disposed so as to face each other in the axial direction and supporting the cleaning part; and a pair of housing shaft portions that is formed on the pair of wall portions in a protruding manner in the axial direction from outer surfaces of the pair of wall portions. The movement mechanism includes: a unit housing portion that houses the cleaning unit disposed at the mounting and removing position; a pair of support members; a rotation drive unit; and a positioning portion. The pair of support members is disposed in the unit housing portion and is capable of supporting the cleaning housing so as to sandwich the cleaning housing from both sides in the axial direction, and the pair of support members each has a shaft support portion that receives the housing shaft portions and supports the housing shaft portion in a rotatable manner. The rotation drive unit is disposed above the shaft support portions and is configured to rotate the pair of support members about a first center axis parallel to the axial direction the such that the cleaning unit moves between the cleaning position and the mounting and removing position in a state where the pair of housing shaft portions is pivotally supported on the pair of shaft support portions. Further, the rotation drive unit rotates the pair of support members while allowing the pair of housing shaft portions to be rotated relative to the pair of shaft support portions such that the cleaning unit maintains an orientation where the cleaning part faces upward. The positioning portion is configured to be brought into contact with the cleaning unit at the cleaning position and is configured to position the cleaning unit such that the cleaning part is capable of cleaning the conveyance roller. The rotation drive unit includes: a shaft that extends along the axial direction and forms the first center axis; a drive unit that generates a rotational drive force for rotating the shaft; a pair of fixing members that is fixed to the shaft respectively so as to be capable of holding the pair of support members; and a pair of spring members. The pair of spring members is disposed so as to be interposed between the pair of support members and the pair of fixing members. The pair of spring members is elastically deformed between the fixing members and the support members so as to suppress a rotational force of the fixing members generated by the drive unit from being applied to the support members when the cleaning unit that has reached the cleaning position is brought into contact with the positioning portion so that rotation of the pair of support members about the first center axis is restricted.

An image forming apparatus according to another aspect of the present disclosure includes: an apparatus body; a conveyance roller configured to convey a sheet; an image forming unit configured to form an image on the sheet; and the above-described cleaning device configured to clean the conveyance roller.

DETAILED DESCRIPTION

Hereinafter, a cleaning device and an image forming apparatus according to an embodiment of the present disclosure are described with reference to drawings.

Figure 1:
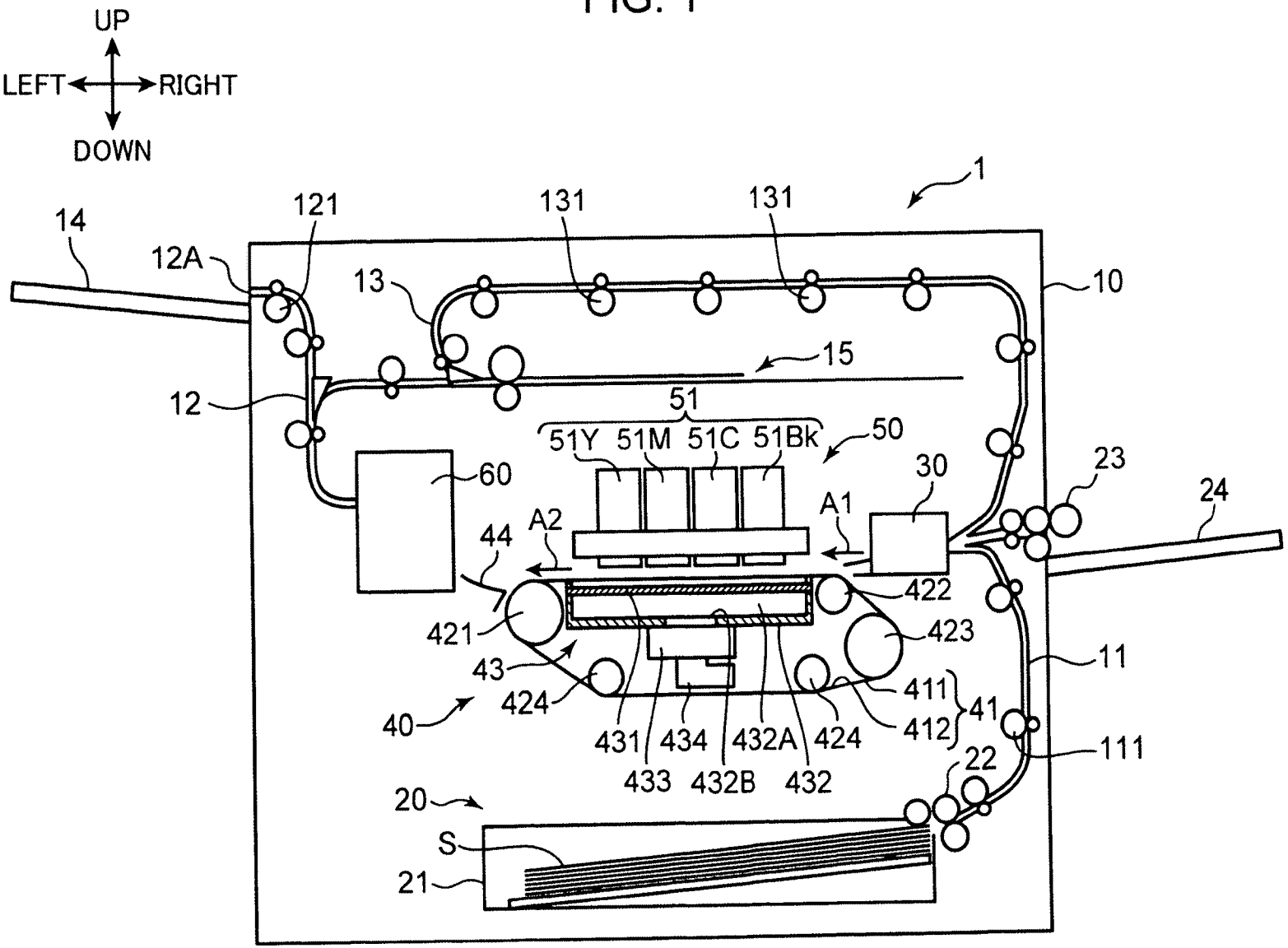
FIG. 1 is a schematic cross-sectional view showing an internal structure of an image forming apparatus according to an embodiment of the present disclosure.

FIG. 1 is a schematic cross-sectional view showing an internal structure of an image forming apparatus 1 according to the embodiment of the present disclosure. The image forming apparatus 1 shown in FIG. 1 is an ink jet recording apparatus which forms (records) an image on a sheet S by ejecting ink droplets. The image forming apparatus 1 includes an apparatus body 10, a paper supply unit 20, a resist roller unit 30, a belt conveyance unit 40, an image forming unit 50, and a curl correction unit 60.

The apparatus body 10 is a box-shaped housing that houses various devices for forming an image on the sheet S. In the apparatus body 10, a first conveyance path 11, a second conveyance path 12, and a third conveyance path 13 which form a conveyance path of the sheet S are formed.

The paper supply unit 20 supplies the sheet S to the first conveyance path 11. The paper supply unit 20 includes a paper supply cassette 21 and a paper supply roller 22. The paper supply cassette 21 is detachably mounted on the apparatus body 10 and sheets S are stored in the paper supply cassette 21. The paper supply roller 22 is disposed on a right side of an upper end portion of the paper supply cassette 21. The paper supply roller 22 conveys the sheet S stored in the paper supply cassette 21 to a downstream side of the first conveyance path 11.

The sheet S supplied to the first conveyance path 11 is conveyed to the resist roller unit 30 disposed on a downstream end of the first conveyance path 11 by a pair of first conveyance rollers 111 disposed on the first conveyance path 11. A paper supply tray 24 is disposed on a right side surface of the apparatus body 10, and sheets S can be placed on an upper surface of the paper supply tray 24. The sheets S placed on the paper supply tray 24 are fed out toward the resist roller unit 30 by the paper supply roller 23.

The resist roller unit 30 is a device which conveys the sheet S conveyed by way of the first conveyance path 11 or the paper supply roller 23 toward a conveyance belt 41 of the belt conveyance unit 40 in a sheet conveyance direction A1. The resist roller unit 30 and the belt conveyance unit 40 convey the sheet S at different positions. Details of the resist roller unit 30 are described later.

The sheet S conveyed by the resist roller unit 30 is conveyed by the belt conveyance unit 40 in a sheet conveyance direction A2. The sheet conveyance directions A1 and A2 are leftward directions in FIG. 1.

The belt conveyance unit 40 is disposed below the image forming unit 50. The belt conveyance unit 40 conveys the sheet S conveyed by the resist roller unit 30 in the sheet conveyance direction A2 toward the curl correction unit 60 such that the sheet S passes below the image forming unit 50. The belt conveyance unit 40 includes a conveyance belt 41 (conveyance portion), a first support roller 421, a second support roller 422, a third support roller 423, a pair of fourth support rollers 424, and a suction unit 43.

The conveyance belt 41 is an endless belt having a predetermined width in a front-rear direction and extending in a left-right direction. The conveyance belt 41 is disposed so as to face the image forming unit 50, and conveys the sheet S in the sheet conveyance direction A2 on an outer peripheral surface 411. An image forming position where an image is formed on the sheet S by the image forming unit 50 is set on an orbital movement path of the conveyance belt 41.

The conveyance belt 41 is supported in an extended manner between and by the first support roller 421, the second support roller 422, the third support roller 423, and the pair of fourth support rollers 424. The suction unit 43 is disposed inside the conveyance belt 41 which is supported in an extended manner as described above in a state where the suction unit 43 faces an inner peripheral surface 412 of the conveyance belt 41. The first support roller 421 is rotatably driven by a drive motor (not shown), and allows the conveyance belt 41 to orbit in a predetermined orbital direction. The conveyance belt 41 has a plurality of suction holes penetrating the conveyance belt 41 in a thickness direction from the outer peripheral surface 411 to the inner peripheral surface 412.

The suction unit 43 is disposed so as to face the image forming unit 50 with the conveyance belt 41 interposed therebetween. The suction unit 43 brings the sheet S into close contact with the outer peripheral surface 411 of the conveyance belt 41 by generating a negative pressure between the sheet S held on the outer peripheral surface 411 of the conveyance belt 41 and the conveyance belt 41. The suction unit 43 includes a belt guide member 431, a suction housing 432, a suction device 433, and an exhaust duct 434.

The belt guide member 431 guides the orbital movement of the conveyance belt 41 in an interlocking manner with the rotation of the first support roller 421 between the first support roller 421 and the second support roller 422.

The suction unit 43 generates a suction force by sucking air from a space above the conveyance belt 41 through a groove portion and a through hole formed in the belt guide member 431 and the suction holes of the conveyance belt 41. Due to such a suction force, an airflow (suction air) toward the suction unit 43 is generated in a space formed above the conveyance belt 41. When the sheet S is conveyed onto the conveyance belt 41 by the resist roller unit 30 and covers a part of the outer peripheral surface 411 of the conveyance belt 41, a suction force (negative pressure) acts on the sheet S, and the sheet S is brought into close contact with the outer peripheral surface 411 of the conveyance belt 41.

The suction housing 432 is a box-shaped housing having an upper opening, and the suction housing 432 is disposed below the conveyance belt 41 such that the upper opening is covered by the belt guide member 431. The suction housing 432 defines a suction space 432A in cooperation with the belt guide member 431.

An opening portion 432B is formed in a bottom wall portion of the suction housing 432, and the suction device 433 is disposed corresponding to the opening portion 432B. The exhaust duct 434 is connected to the suction device 433. The exhaust duct 434 is connected to an exhaust port (not shown) formed in the apparatus body 10.

The image forming unit 50 is disposed above the belt conveyance unit 40. The image forming unit 50 forms an image by applying image forming processing to the sheet S which is conveyed in the sheet conveyance direction A2 in a state where the sheet S is held on the outer peripheral surface 411 of the conveyance belt 41. In this embodiment, an image forming method of the image forming unit 50 is an ink jet method, and an image is formed on the sheet S by ejecting ink droplets.

The image forming unit 50 includes line heads 51 (51Bk, 51C, 51M, 51Y). The line head 51Bk ejects black ink droplets, the line head 51C ejects cyan ink droplets, the line head 51M ejects magenta ink droplets, and the line head 51Y ejects yellow ink droplets. The line heads 51Bk, 51C, 51M, and 51Y are arranged adjacently to each other from the upstream side to the downstream side in the sheet conveyance direction A1.

The line heads 51 form an image on the sheet S by ejecting ink droplets on the sheet S conveyed in the sheet conveyance direction A2 in a state where the sheet S is held on the outer peripheral surface 411 of the conveyance belt 41. As a result, an image is formed on the sheet S.

The sheet S on which the image is formed is conveyed by the conveyance belt 41, and is discharged (fed out) toward the curl correction unit 60 while being guided by a sheet discharge guide unit 44. The curl correction unit 60 is disposed downstream of the conveyance belt 41 in the sheet conveyance direction A2 with the sheet discharge guide unit 44 sandwiched therebetween. The curl correction unit 60 corrects the curl of the sheet S on which the image is formed while conveying the sheet S to the downstream side.

The sheet S whose curl has been corrected by the curl correction unit 60 is fed out to the second conveyance path 12. The second conveyance path 12 extends along a left side surface of the apparatus body 10. The sheet S fed out to the second conveyance path 12 is conveyed by a pair of second conveyance rollers 121 disposed on the second conveyance path 12 toward a paper discharge port 12A formed on a left side of the apparatus body 10, and the sheet S is discharged onto a paper discharge unit 14 from the paper discharge port 12A.

On the other hand, in a case where both-side printing is performed on the sheet S, the sheet S on which the image forming processing of a first surface (front surface) has been completed is fed out from the second conveyance path 12 to a sheet reversing unit 15. The sheet reversing unit 15 is a conveyance path branched from a middle portion of the second conveyance path 12, and is a part where the sheet S is reversed (switched back). The sheet S where the front surface and the back surface are reversed by the sheet reversing unit 15 is fed out to the third conveyance path 13. The sheet S fed out to the third conveyance path 13 is reversely fed by a pair of third conveyance rollers 131 provided in the third conveyance path 13, and is supplied again onto the outer peripheral surface 411 of the conveyance belt 41 by way of the resist roller unit 30 in a state where the front surface and the back surface of the sheet S are reversed. With respect to the sheet S supplied onto the outer peripheral surface 411 of the conveyance belt 41 in a state where the front surface and the back surface of the sheet S are reversed as described above, the image forming processing is applied to a second surface (back surface) on a side opposite to the first surface of the sheet S by the image forming unit 50 while being conveyed by the conveyance belt 41. The sheet S on which both-side printing has been completed passes through the second conveyance path 12, and is discharged onto the paper discharge unit 14 from the paper discharge port 12A.

Figure 2:
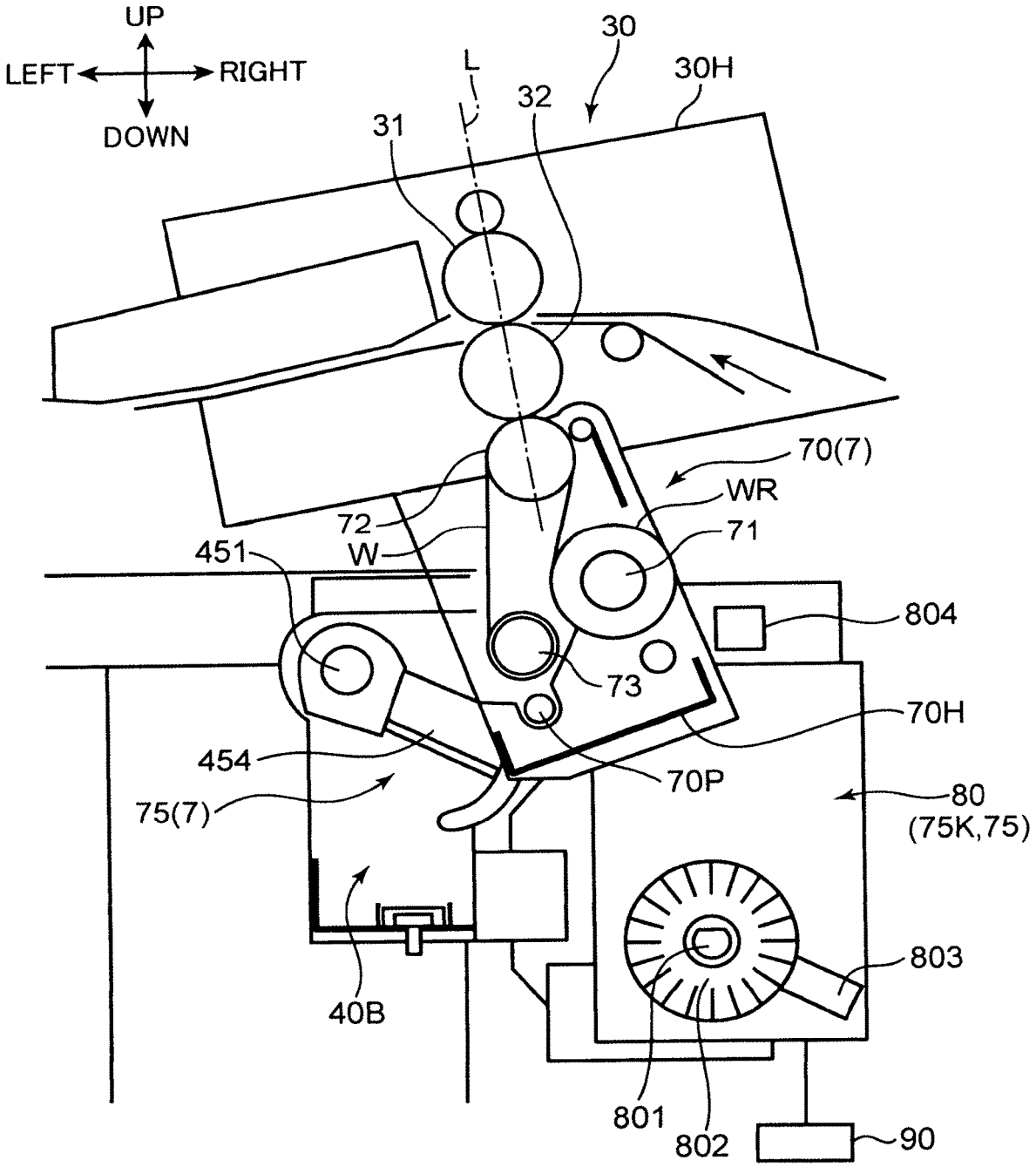
FIG. 2 is a cross-sectional view of a pair of resist rollers, a cleaning unit of the image forming apparatus and the surrounding of these parts according to an embodiment of the present disclosure, and is also a cross-sectional view showing a state where the cleaning unit is disposed at a cleaning position.

FIG. 2 is a cross-sectional view of the pair of resist rollers, the cleaning unit 70 of the image forming apparatus 1 and the surrounding of these parts according to the present embodiment, and is a cross-sectional view showing a state where the cleaning unit 70 is disposed at a cleaning position.

The above-described resist roller unit 30 has a resist housing 30H and a pair of resist rollers consisting of a resist upper roller 31 (upper resist roller) and a resist lower roller 32 (conveyance roller, lower resist roller). The resist housing 30H is mounted on the apparatus body 10, and rotatably supports the resist upper roller 31 and the resist lower roller 32. The sheet S is conveyed into a nip portion formed between the pair of resist rollers as indicated by an arrow in FIG. 2 in the resist housing 30H. The resist roller unit 30 has a roller driving unit (not shown) which rotatably drives the resist upper roller 31 and the resist lower roller 32.

The resist upper roller 31 is a roller disposed on an upper side out of the pair of resist rollers. The resist upper roller 31 is formed of a metal roller.

The resist lower roller 32 is a roller disposed on a lower side out of the pair of resist rollers. The resist lower roller 32 is formed of a rubber roller, and a tetrafluoroethylene-perfluoroalkoxy ethylene copolymer resin (PFA) tube is wound around (fitted in) an outer peripheral surface of the resist lower roller 32.

As shown in FIG. 2, a straight line L connecting the center of the resist upper roller 31 and the center of the resist lower roller 32 is inclined at an acute angle (for example, 10 degrees) with respect to a vertical direction. In other words, the resist lower roller 32 is disposed at the position displaced upstream in a conveyance direction of the sheet S with respect to the resist upper roller 31.

Figure 26:
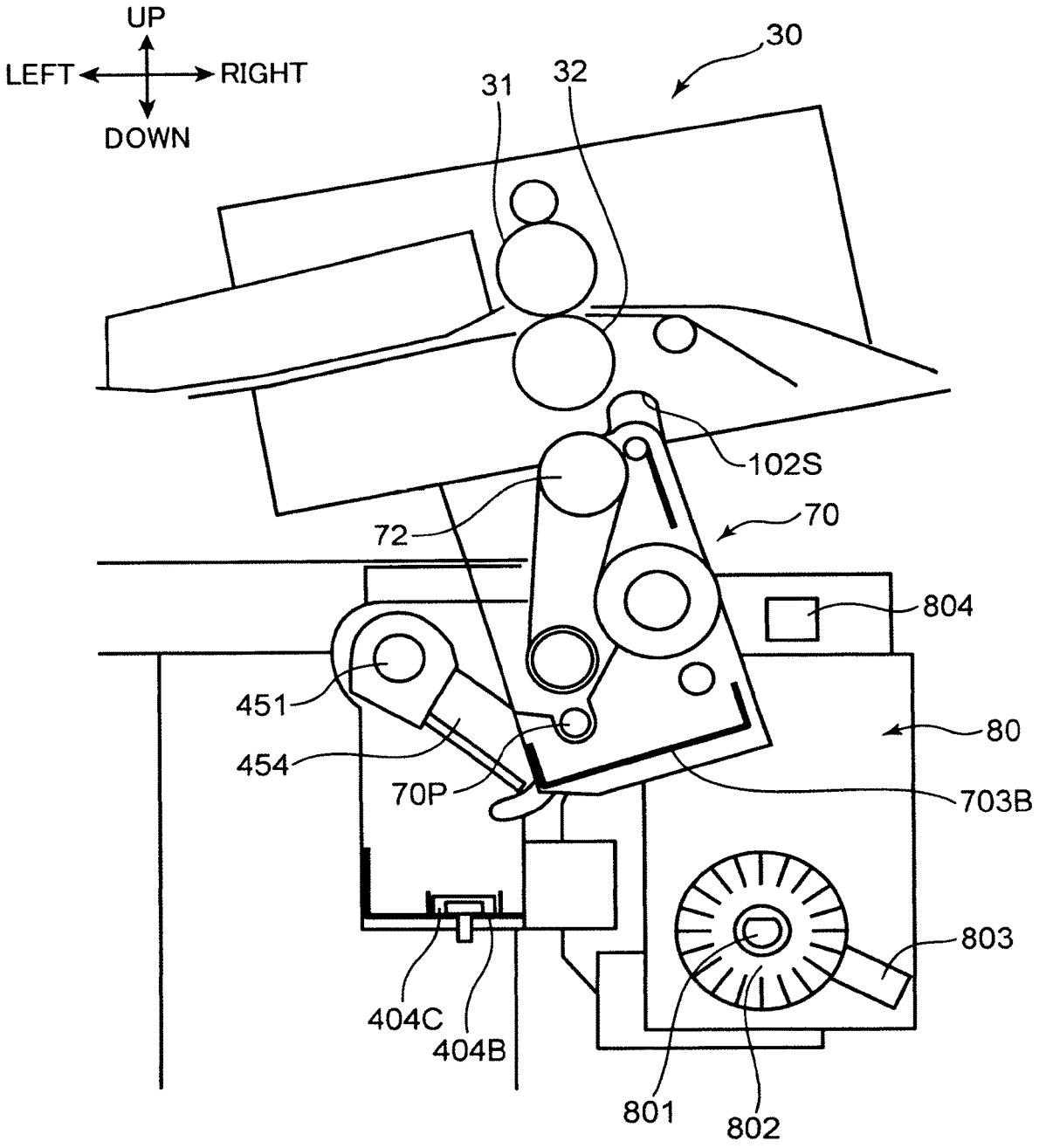
FIG. 26 is a cross-sectional view showing a state where the cleaning unit is disposed at a separation position.

Further, the image forming apparatus 1 includes a cleaning device 7. The cleaning device 7 can clean a surface of the resist lower roller 32. The cleaning device 7 has the cleaning unit 70 and a movement mechanism 75 (see FIG. 14). The movement mechanism 75 has a function of moving the cleaning unit 70 between the cleaning position (FIG. 2), a mounting and removing position (FIG. 24), and a separation position (FIG. 26).

Figure 3:
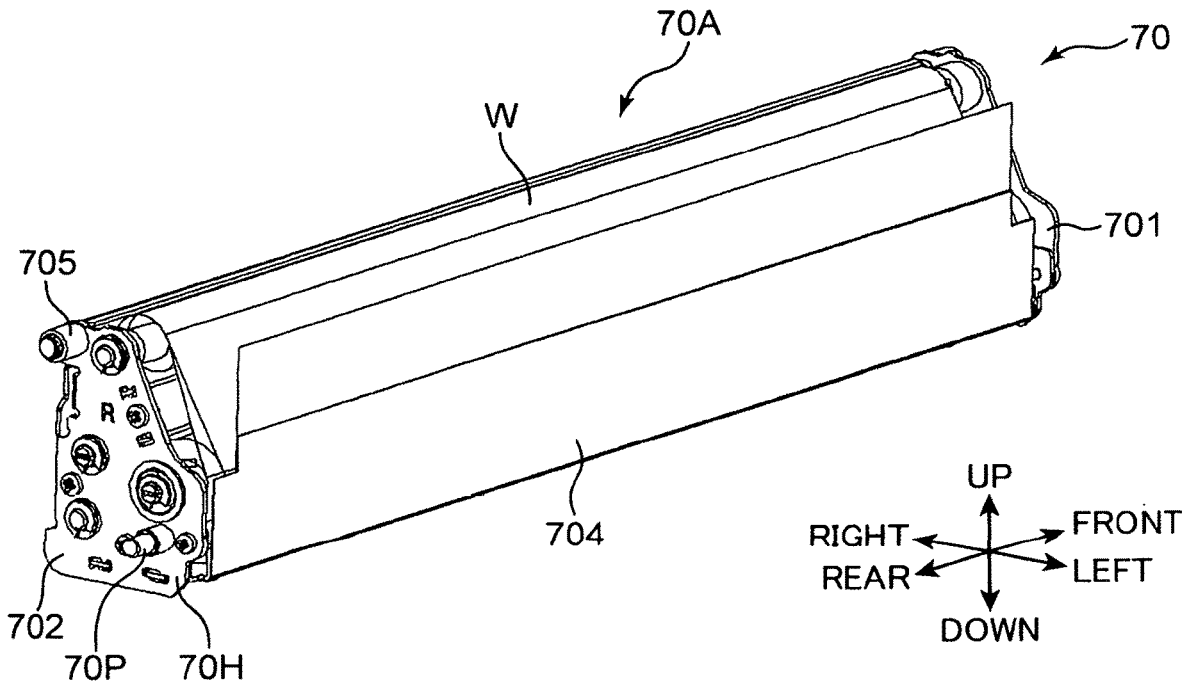
FIG. 3 is a perspective view of the cleaning unit.
Figure 4:
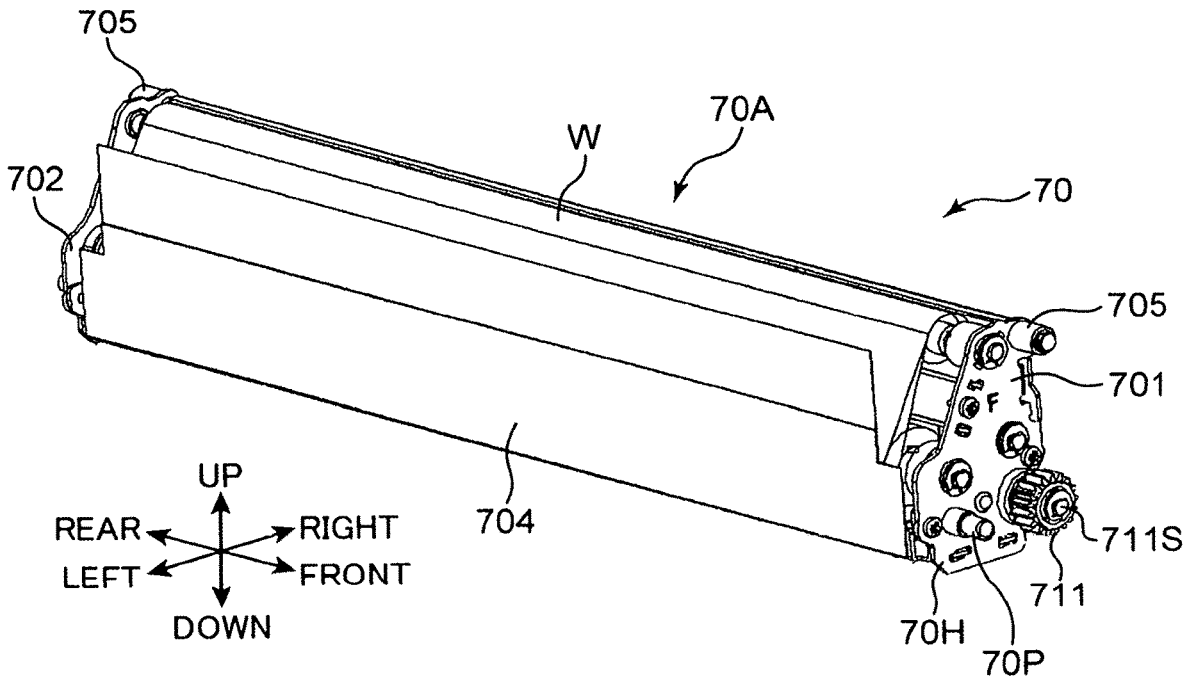
FIG. 4 is a perspective view of the cleaning unit.
Figure 5:
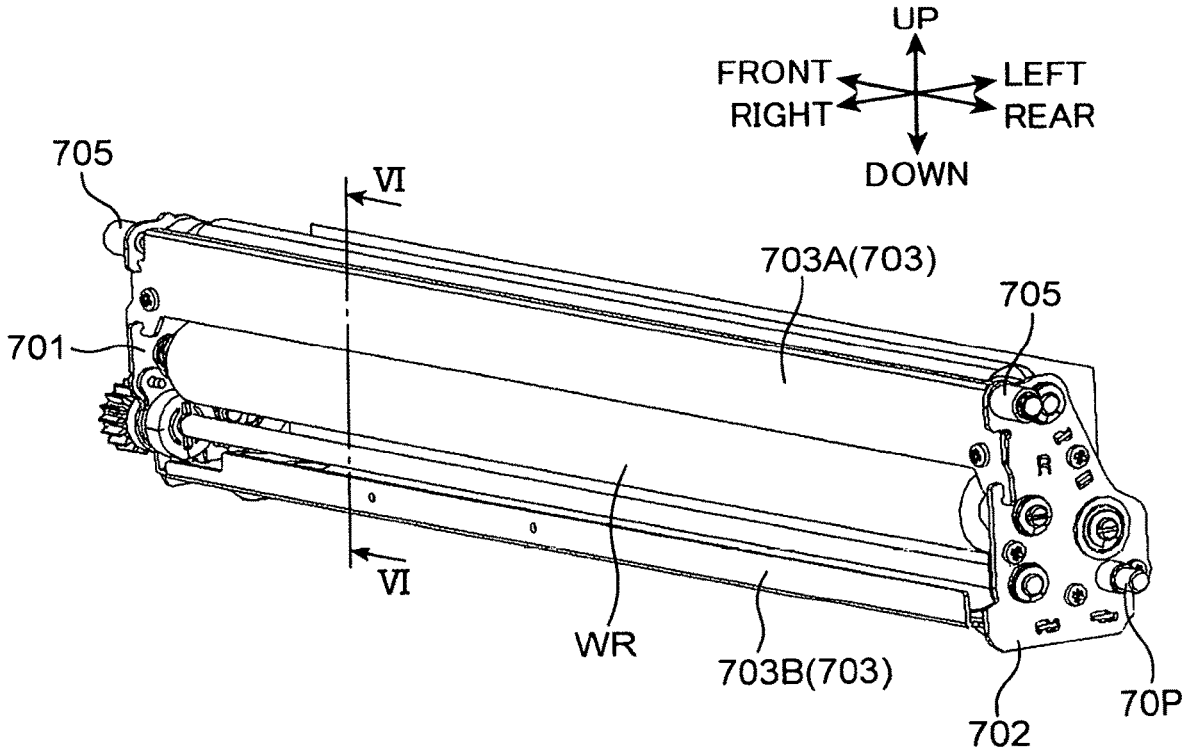
FIG. 5 is a perspective view of the cleaning unit.
Figure 6:
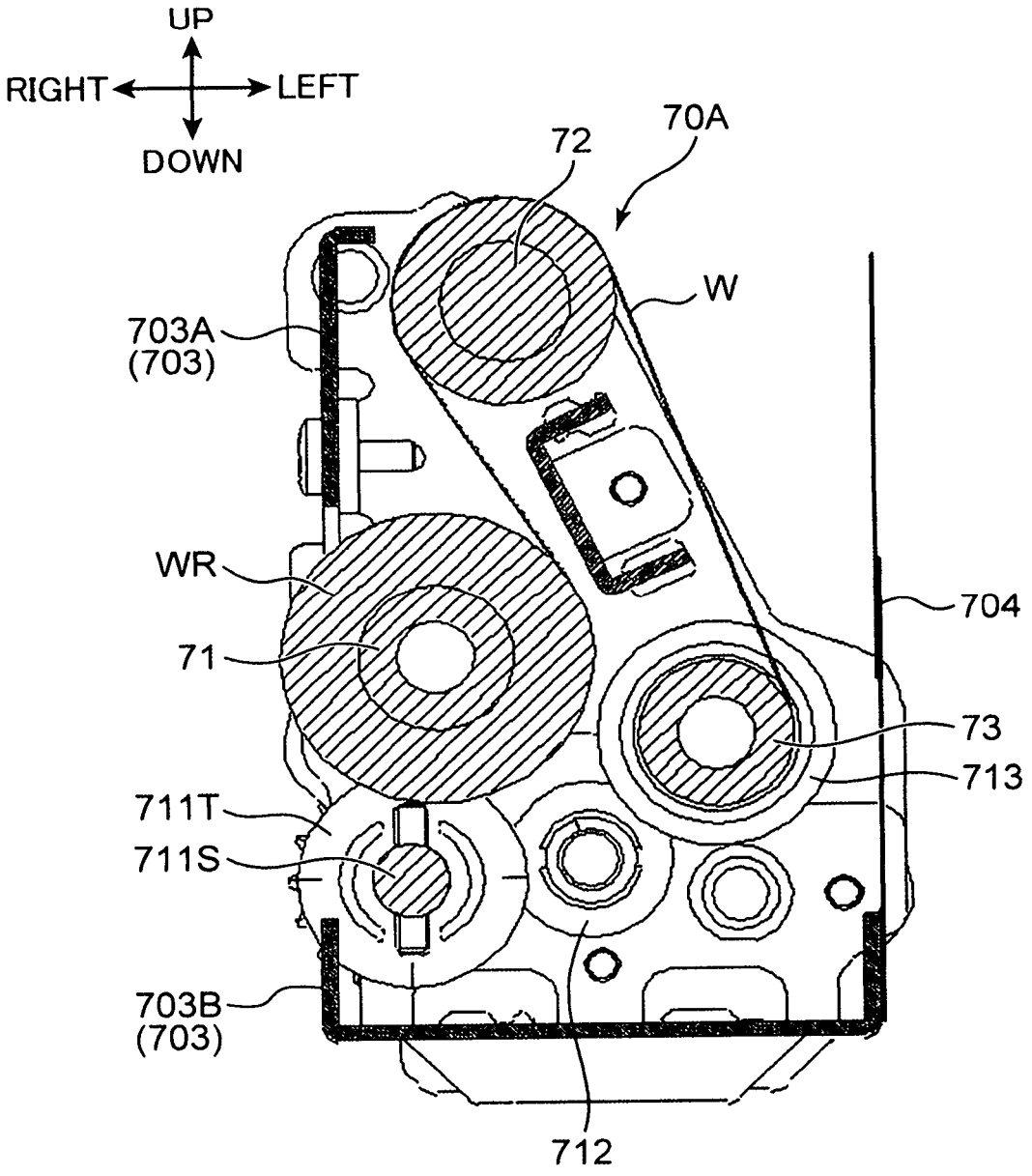
FIG. 6 is a cross-sectional view taken along line VI-VI in FIG. 5.
Figure 7:
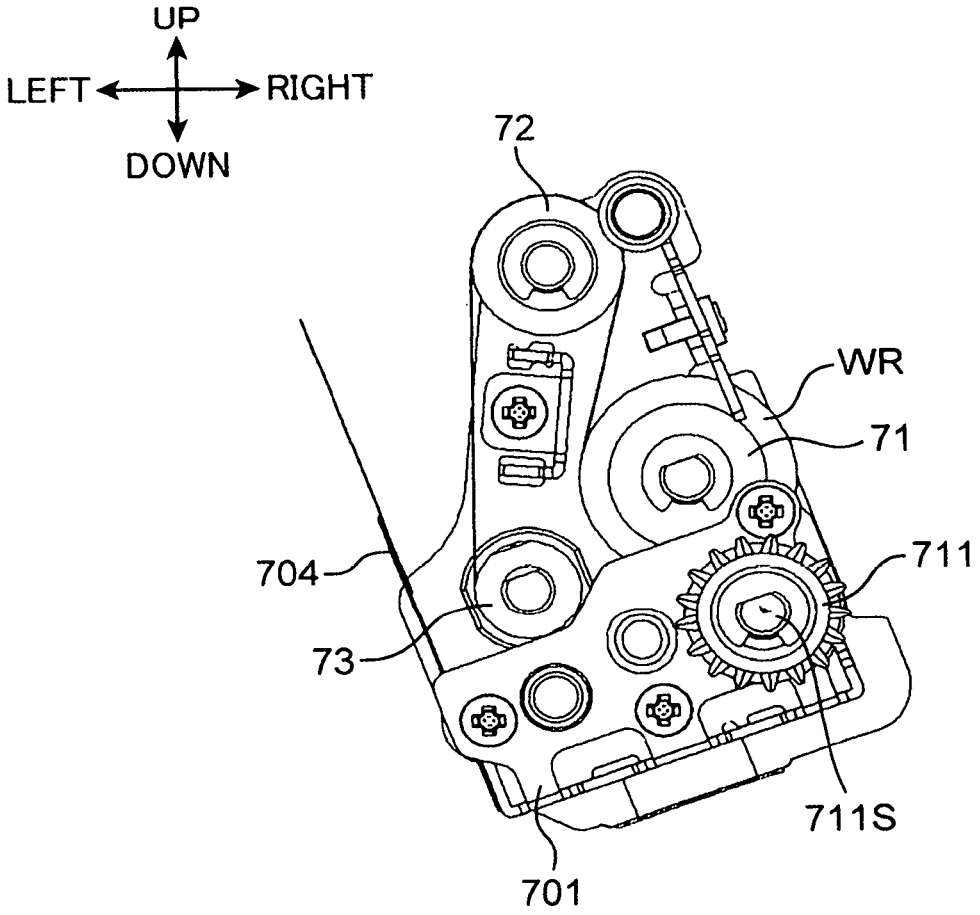
FIG. 7 is a front view showing the cleaning unit with some members omitted.
Figure 8:
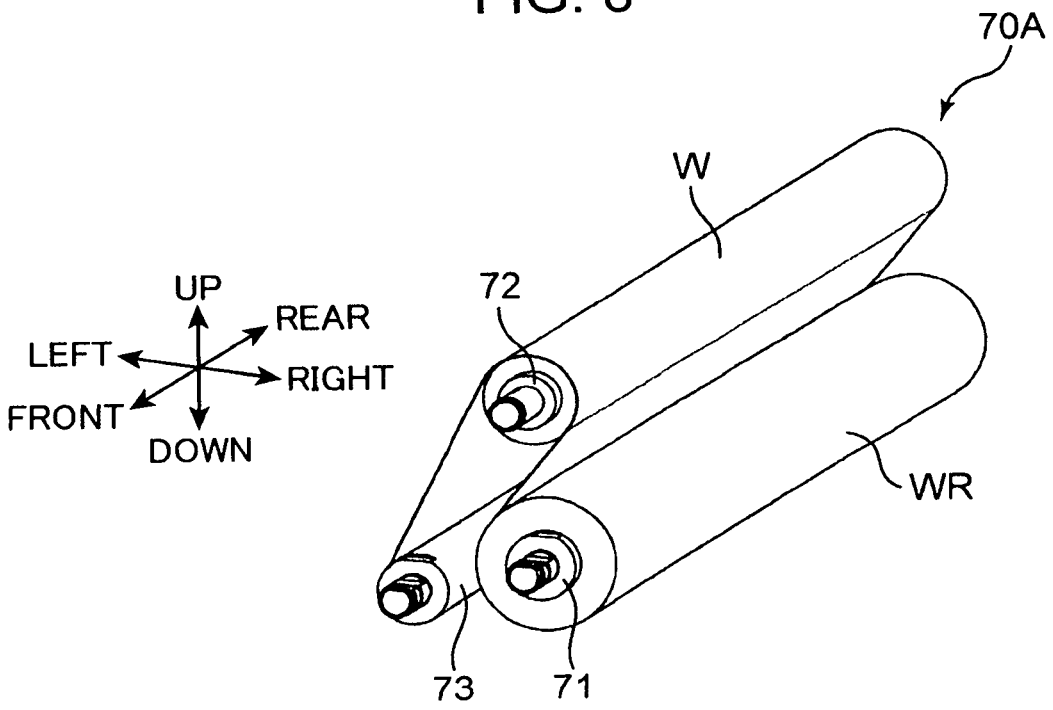
FIG. 8 is a perspective view showing an internal structure of the cleaning unit.

FIGS. 3 to 5 are perspective views of the cleaning unit 70 of the image forming apparatus 1 according to the present embodiment. FIG. 6 is a cross-sectional view of the cleaning unit 70 taken along line VI-VI in FIG. 5. FIG. 7 is a front view showing the cleaning unit 70 with some members omitted. FIG. 8 is a perspective view showing an internal structure of the cleaning unit 70 (cleaning part 70A).

The cleaning unit 70 has a cleaning part 70A and a cleaning housing 70H. The cleaning part 70A has a shape extending along an axial direction of the resist lower roller 32, and is brought into contact with a surface of the resist lower roller 32 from below so as to clean the surface of the resist lower roller 32.

The cleaning housing 70H supports the cleaning part 70A. The cleaning housing 70H has a front wall 701 and a rear wall 702 (a pair of wall portions), a connection wall 703, a pair of unit fulcrum pins 70P (housing shaft portions), a sheet member 704, and a pair of guide rollers 705 (guide rollers). The front wall 701, the rear wall 702, and the connection wall 703 of the cleaning housing 70H are made of a metal material (magnetic material).

The front wall 701 and the rear wall 702 are disposed so as to face each other in the front-rear direction (axial direction of the resist lower roller 32) and support the cleaning part 70A. The connection wall 703 connects the front wall 701 and the rear wall 702 along the front-rear direction. The connection wall 703 has a side wall 703A and a bottom wall 703B (FIGS. 5 and 6). A pair of front and rear ribs 703T is formed on the bottom wall 703B in a protruding manner (see FIGS. 19 and 20).

The pair of unit fulcrum pins 70P is formed on the front wall 701 and the rear wall 702 (the pair of wall portions) in a protruding manner from outer surfaces of the front wall 701 and the rear wall 702 in the front-rear direction respectively. The unit fulcrum pins 70P are disposed on left lower portions of the front wall 701 and the rear wall 702 respectively. Each unit fulcrum pin 70P has a circular cylindrical shape in two stages where an outer diameter of the unit fulcrum pin 70P decreases toward a distal end portion.

The sheet member 704 is fixed to the bottom wall 703B so as to define a left side surface of the cleaning unit 70 (FIG. 6). The sheet member 704 prevents a collected matter such as paper dust collected by the cleaning unit 70 from scattering toward the belt conveyance unit 40 (FIG. 1).

The pair of guide rollers 705 is supported by the front wall 701 and the rear wall 702 above the unit fulcrum pins 70P respectively, and each guide roller 705 includes an outer peripheral surface which is rotatable about a center axis (second center axis) parallel to the front-rear direction. The guide rollers 705 are disposed on right upper portions of the front wall 701 and the rear wall 702 respectively. The pair of guide rollers 705 has a function of guiding the cleaning unit 70 when the cleaning unit 70 moves to the mounting and removing position, the separation position, and the cleaning position described above.

The cleaning part 70A includes: a web W; and a web driven roller 71 (feed-out roller), a pressing roller 72, and a web drive roller 73 (take-up roller) which are respectively rotatably supported by the front wall 701 and the rear wall 702 (see FIGS. 6 to 8). The web W is formed of a strip-shaped member having a contact surface capable of being brought into contact with the surface of the resist lower roller 32. The web W is formed of a cloth material such as a nonwoven fabric as an example. In the present embodiment, as shown in FIGS. 6 and 8, a web roll WR which is formed by winding the web W in a roll shape in advance is fitted on the web driven roller 71. Then, a distal end of the web W is caught by an outer peripheral surface of the pressing roller 72 and, thereafter, the distal end of the web W is fixed to an outer peripheral surface of the web drive roller 73. The pressing roller 72 is brought into contact with a back surface of the web W and presses a front surface of the web W to the resist lower roller 32. When the cleaning unit 70 is disposed at the above-described cleaning position (FIG. 2), the pressing roller 72 is brought into contact with the resist lower roller 32 with the web W sandwiched therebetween. The web driven roller 71 feeds out the web W such that a portion of the web W which is brought into contact with the resist lower roller 32 changes, and the web drive roller 73 takes up the web W. As shown in FIG. 5, a state of the web roll WR held by the web driven roller 71 can be visually recognized from the outside of the cleaning unit 70 through an opening portion formed between the side wall 703A and the bottom wall 703B. Accordingly, it is possible to prevent the cleaning unit 70 which is removed from the apparatus body 10 during use and where a feedable amount of the web W becomes small from being erroneously mounted on the apparatus body 10.

Further, the cleaning unit 70 has a unit input gear 711 (FIG. 4), an interlocking gear 711T, a transmission gear 712, and a drive roller gear 713 (FIG. 6).

The unit input gear 711 is rotatably supported at a lower right end portion of the front wall 701. An input gear shaft 711S of the unit input gear 711 penetrates the front wall 701 and extends to the inside (back side) of the front wall 701. The interlocking gear 711T is fixed to the input gear shaft 711S, and rotates integrally with the unit input gear 711.

The transmission gear 712 is rotatably supported on an inner side of the front wall 701, and engages with the interlocking gear 711T and the drive roller gear 713 respectively. The drive roller gear 713 is a gear fixed to one end portion of the web drive roller 73.

Figure 9:
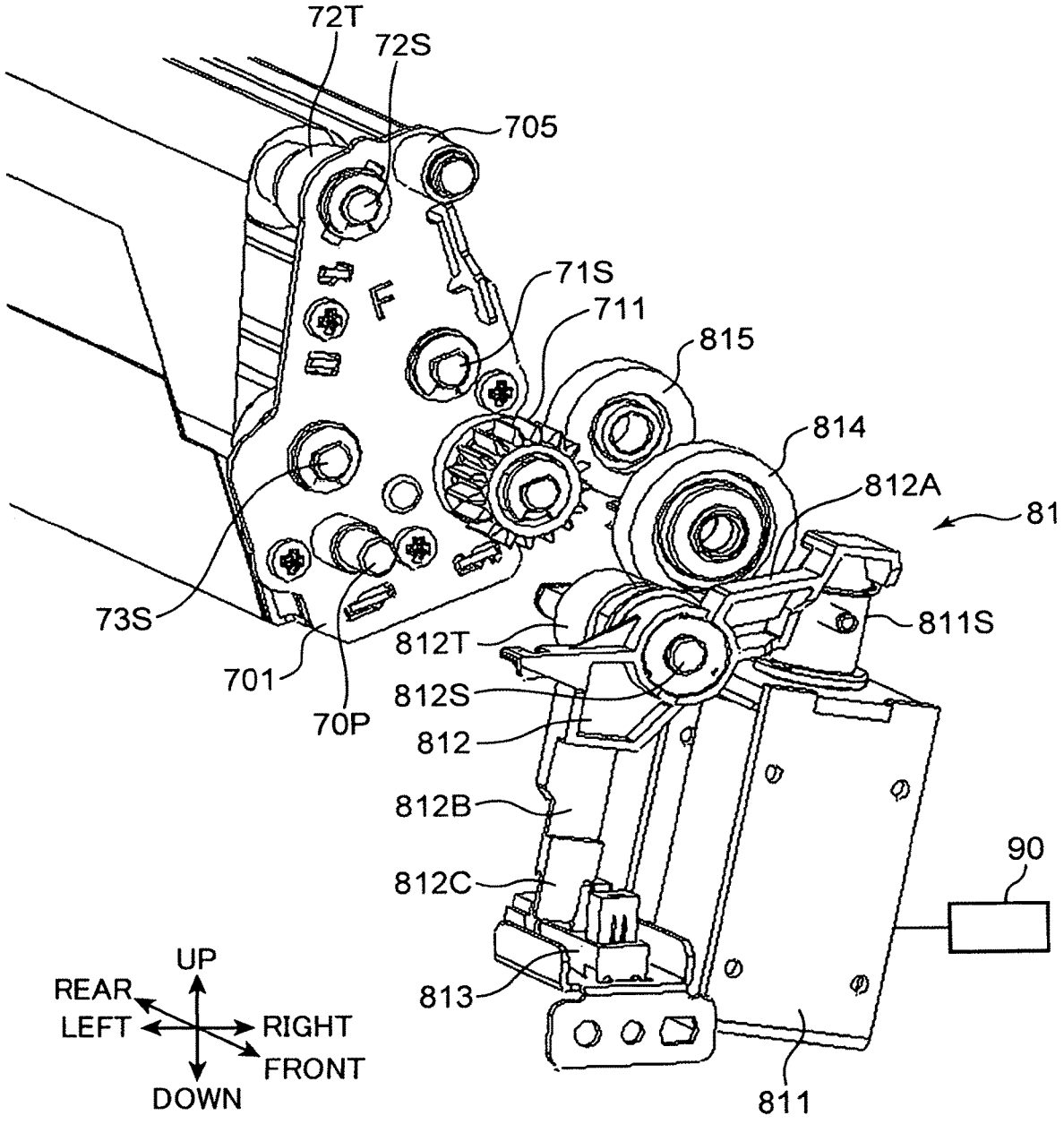
FIG. 9 is a perspective view of the cleaning unit and a web feed-out mechanism.
Figure 10:
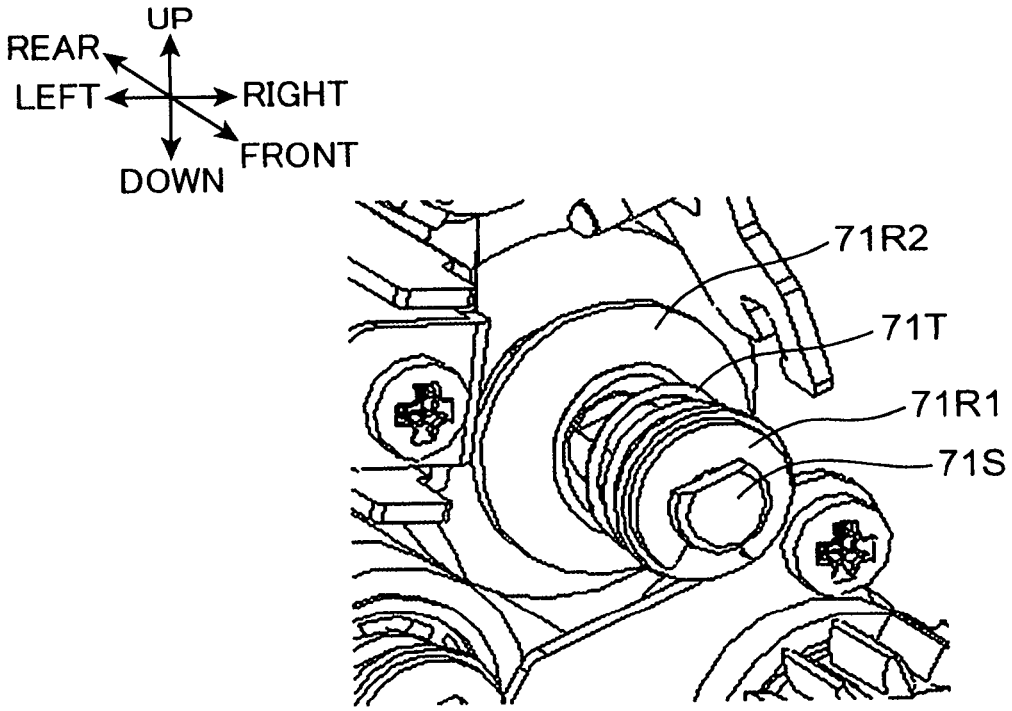
FIG. 10 is an enlarged perspective view showing a part of the cleaning unit in an enlarged manner.
Figure 11:
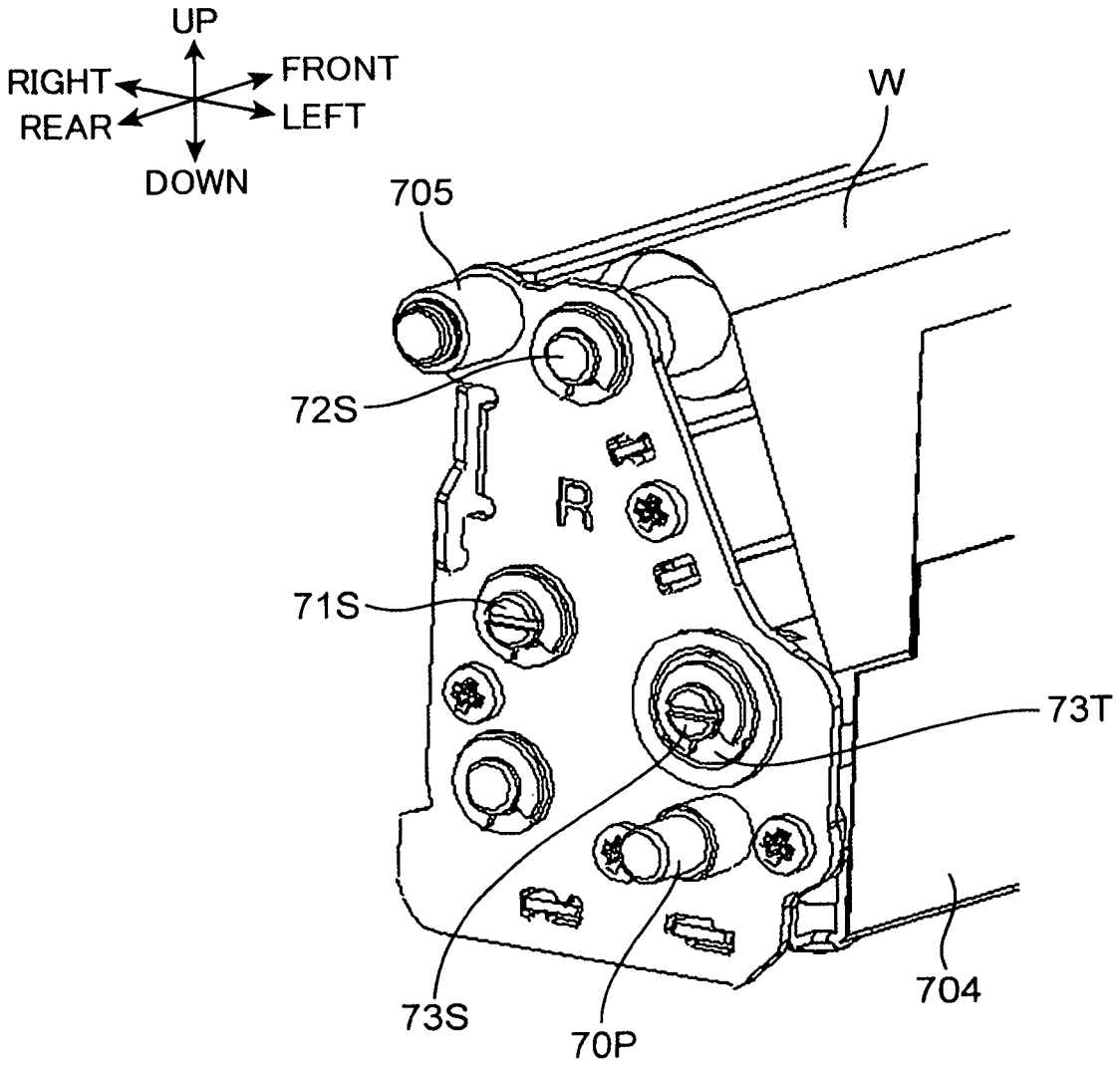
FIG. 11 is an enlarged perspective view showing a part of the cleaning unit in an enlarged manner.

FIG. 9 is a perspective view of the cleaning unit 70 and a web feed-out mechanism 81 of the image forming apparatus 1 according to the present embodiment. FIGS. 10 and 11 are enlarged perspective views each showing a part of the cleaning unit 70 in an enlarged manner.

The cleaning device 7 further includes the web feed-out mechanism 81 (web drive mechanism) and a controller 90. The web feed-out mechanism 81 is mounted on the apparatus body 10 of the image forming apparatus 1. The web feed-out mechanism 81 has a function of feeding out the web W of the cleaning unit 70. The web feed-out mechanism 81 is connected to the cleaning unit 70 by disposing the cleaning unit 70 at the cleaning position. The web feed-out mechanism 81 has a solenoid 811, a rotary arm 812, a third detection sensor 813, a transmission gear 814, and a transmission gear 815.

The solenoid 811 generates a drive force for moving the web W by receiving an instruction signal from the controller 90. The solenoid 811 includes an extendable and retractable shaft 811S. The extendable and retractable shaft 811S extends and retracts with respect to a body of the solenoid 811. The solenoid 811 is supported by a sheet-metal-made drive frame (not shown) which is disposed inside the apparatus body 10.

The rotary arm 812 is rotatably supported on a shaft 812S (FIG. 9) provided to the drive frame disposed inside the apparatus body 10. The shaft 812S is supported by the drive frame such that the shaft 812S is rotatable about a rotation center axis extending in the front-rear direction. The rotary arm 812 has a first arm portion 812A and a second arm portion 812B. The first arm portion 812A extends rightward from the rotation center axis of the rotary arm 812. A distal end portion of the first arm portion 812A is connected to the extendable and retractable shaft 811S. The second arm portion 812B extends toward a side opposite to the first arm portion 812A and downward from the rotation center axis of the rotary arm 812. A detection piece 812C is disposed on a distal end portion (lower end portion) of the second arm portion 812B. A gear portion 812T which can rotate integrally with the shaft 812S is mounted on a rear end portion of the shaft 812S. Further, the web feed-out mechanism 81 has a first one-way clutch (not shown) and a second one-way clutch (not shown). The first one-way clutch is fixedly mounted in the rotary arm 812 and is fitted on the shaft 812S. The second one-way clutch is fixed to the drive frame in a state where the second one-way clutch is disposed adjacently to the first one-way clutch, and is fitted on the shaft 812S.

The third detection sensor 813 is fixed to a left end portion of a body of the solenoid 811. The third detection sensor 813 is a PI sensor which detects the movement (rotation) of the detection piece 812C. The controller 90 can detect a feeding amount of the web roll WR corresponding to the number of times of detection of the detection piece 812C outputted from the third detection sensor 813. When the number of times of detection reaches a threshold number of times set in advance, the controller 90 allows a display unit (not shown) of the image forming apparatus 1 to display an exchange message requesting an exchange of the cleaning unit 70.

The transmission gear 814 is rotatably supported by the apparatus body 10, and engages with the gear portion 812T. The transmission gear 814 is formed of a two-stage gear. In the same manner, the transmission gear 815 is rotatably supported by the apparatus body 10, and the transmission gear 815 engages with a rear gear portion of the two-stage gear of the transmission gear 814, and engages with the above-described unit input gear 711.

FIG. 9 shows a state where the extendable and retractable shaft 811S is retracted (contracted) with respect to the body of the solenoid 811. When the controller 90 inputs an instruction signal to the solenoid 811 from the state shown in FIG. 9, the extendable and retractable shaft 811S protrudes (extends) from the body of the solenoid 811 so that the rotary arm 812 rotates in a counterclockwise direction in FIG. 9 about the shaft 812S. At this stage of the operation, the rotary arm 812 is rotated relative to the shaft 812S by an action of the above-described first one-way clutch so that there is no possibility that the shaft 812S rotates. On the other hand, when the web W is fed out by a predetermined amount, the controller 90 inputs an instruction signal to the solenoid 811 and contracts the extendable and retractable shaft 811S with respect to the body of the solenoid 811. As a result, the rotary arm 812 rotates in a clockwise direction in FIG. 9 about the shaft 812S. At this stage of the operation, the shaft 812S rotates integrally with the rotary arm 812 by a predetermined angle by an action of the above-described first one-way clutch. As a result, a rotational drive force is inputted from the gear portion 812T fixed to the shaft 812S to the unit input gear 711 by way of the transmission gear 814 and the transmission gear 815. Then, the rotational drive force is further transmitted to the unit input gear 711, the interlocking gear 711T, the transmission gear 712, and the drive roller gear 713 of the cleaning unit 70. As a result, the web drive roller 73 rotates by a preset rotation angle, and the web W is moved so as to be taken up by the web drive roller 73. As a result, a portion of the contact surface of the web W which faces the resist lower roller 32 changes. The third detection sensor 813 detects the detection piece 812C each time the rotary arm 812 rotates by one reciprocation and hence, it is detected that the unit input gear 711 has rotated and the web W has been moved.

When the web W is moved, the controller 90 inputs an instruction signal to the solenoid 811 and allows the extendable and retractable shaft 811S to protrude to the body of the solenoid 811 again. At this stage of the operation, it is possible to prevent the shaft 812S from rotating in a reverse direction by an action of the above-described second one-way clutch. Further, as shown in FIG. 11, a one-way clutch 73T mounted on a drive roller shaft 73S of the web drive roller 73 functions so that it is possible to prevent the web drive roller 73 from rotating in the reverse direction. Therefore, each time the controller 90 performs an extending and retracting operation of the extendable and retractable shaft 811S, the web W is moved toward the web drive roller 73 by a predetermined amount. As described above, in the present embodiment, it is possible to feed out the web W from the web roll WR by making use of a slight extending and retracting stroke of the extendable and retractable shaft 811S of the solenoid 811. In another embodiment, the web feed-out mechanism 81 may rotatably drive the web driven roller 71 in addition to the web drive roller 73.

Note that, with reference to FIG. 9, a torque limiter 72T is mounted on a pressing roller shaft 72S of the pressing roller 72. There may be a case where clogging of the sheet S occurs in the image forming apparatus 1 in a state where the web W (the pressing roller 72) of the cleaning device 7 is brought into contact with the resist lower roller 32 and the sheet S is sandwiched between the resist upper roller 31 and the resist lower roller 32. In this case, a user attempts to remove the sheet S clogged between the resist upper roller 31 and the resist lower roller 32 by opening a predetermined cover of the apparatus body 10 of the image forming apparatus 1, and by pulling out the sheet S in a direction opposite to a direction indicated by an arrow in FIG. 2. At this stage of the operation, when a force for pulling out the sheet S is transmitted from the resist lower roller 32 to the pressing roller 72, the web W is excessively fed out from the pressing roller 72 toward the web drive roller 73. In the present embodiment, since the torque limiter 72T is mounted on the pressing roller shaft 72S, when a sudden rotational force is applied to the pressing roller 72, the rotation of the pressing roller 72 is locked and hence, feeding out of the web W can be prevented.

Further, with reference to FIG. 10, in the present embodiment, on a driven roller shaft 71S of the web driven roller 71, a brake spring 71T is interposed between an E-ring 71R1 and a flange 71R2 in a compressed and deformed state. In FIG. 10, the illustration of the front wall 701 in FIG. 9 is omitted. The flange 71R2 is a ring-shaped flange fixed to the pressing roller shaft 72S of the pressing roller 72. A rear end portion of the brake spring 71T is brought into contact with the flange 71R2. A front end portion of the brake spring 71T is brought into contact with a back surface of the front wall 701. As a result, a compression force of the brake spring 71T is applied to the pressing roller 72 by way of the flange 71R2 and hence, it is possible to prevent the pressing roller 72 from being unnecessarily rotated. As a result, it is possible to prevent the web W from being fed out from the pressing roller 72 in spite of a fact that the controller 90 is not controlling the solenoid 811.

The movement mechanism 75 (FIG. 2) moves the cleaning unit 70 among the cleaning position (FIG. 2), the mounting and removing position below the cleaning position (FIG. 24), and the separation position (FIG. 26) located between the cleaning position and the mounting and removing position. The movement mechanism 75 allows the cleaning part 70A to be brought into contact with the resist lower roller 32 at the cleaning position. The movement mechanism 75 allows the cleaning part 70A to be disposed below the resist lower roller 32 in a separated manner at the mounting and removing position. The movement mechanism 75 also allows the cleaning unit 70 to be mounted on or to be removed from the apparatus body 10 at the mounting and removing position. At the separation position, the cleaning part 70A is disposed below the resist lower roller 32 in a separated manner, and the connection between the cleaning unit 70 and the above-described web feed-out mechanism 81 (web drive mechanism) is released.

Figure 12:
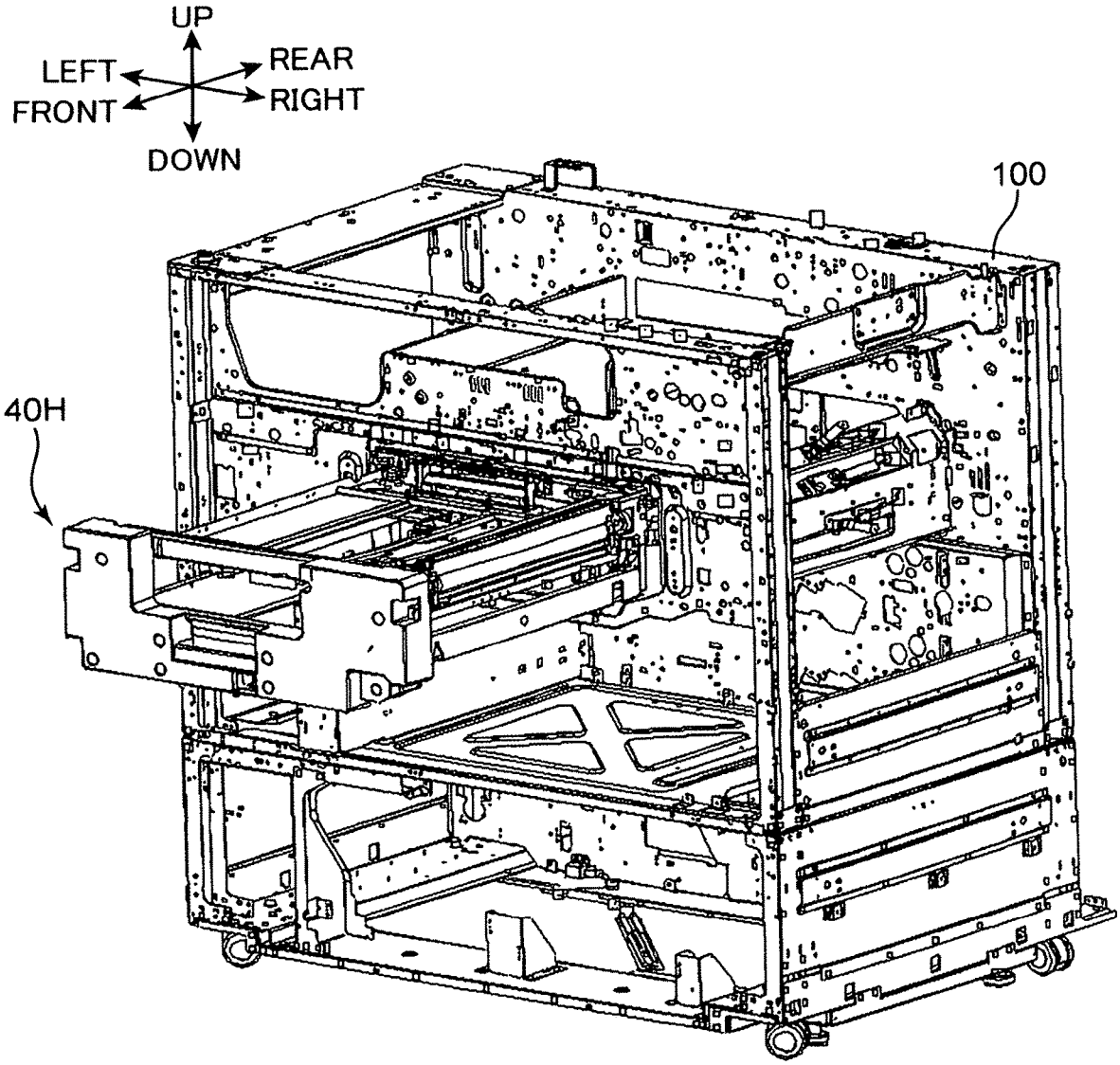
FIG. 12 is a perspective view showing a state where a conveyance unit frame is removed from a body frame which forms an apparatus body of the image forming apparatus according to the embodiment of the present disclosure.
Figure 13:
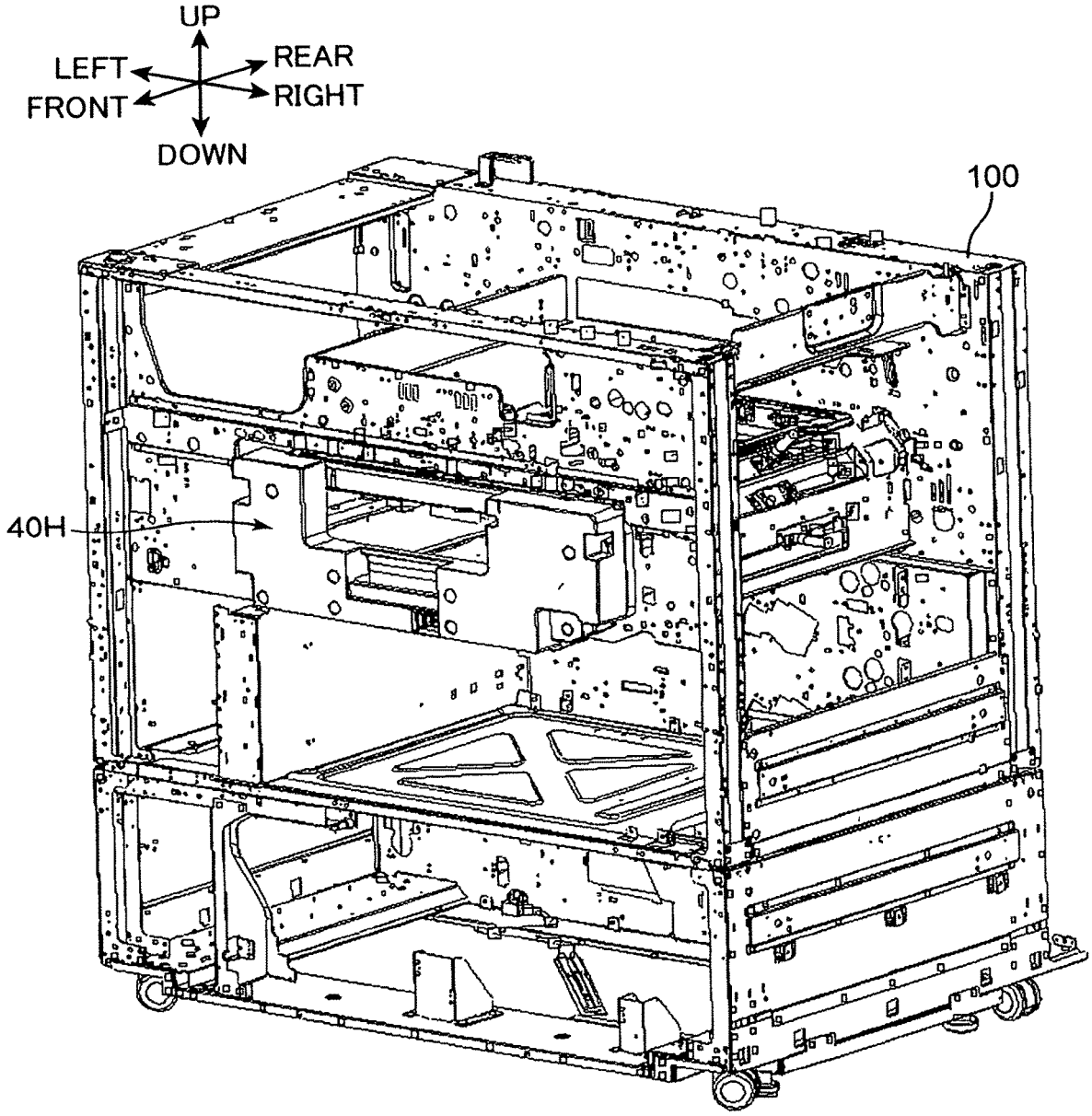
FIG. 13 is a perspective view showing a state where the conveyance unit frame is mounted on the body frame.
Figure 14:
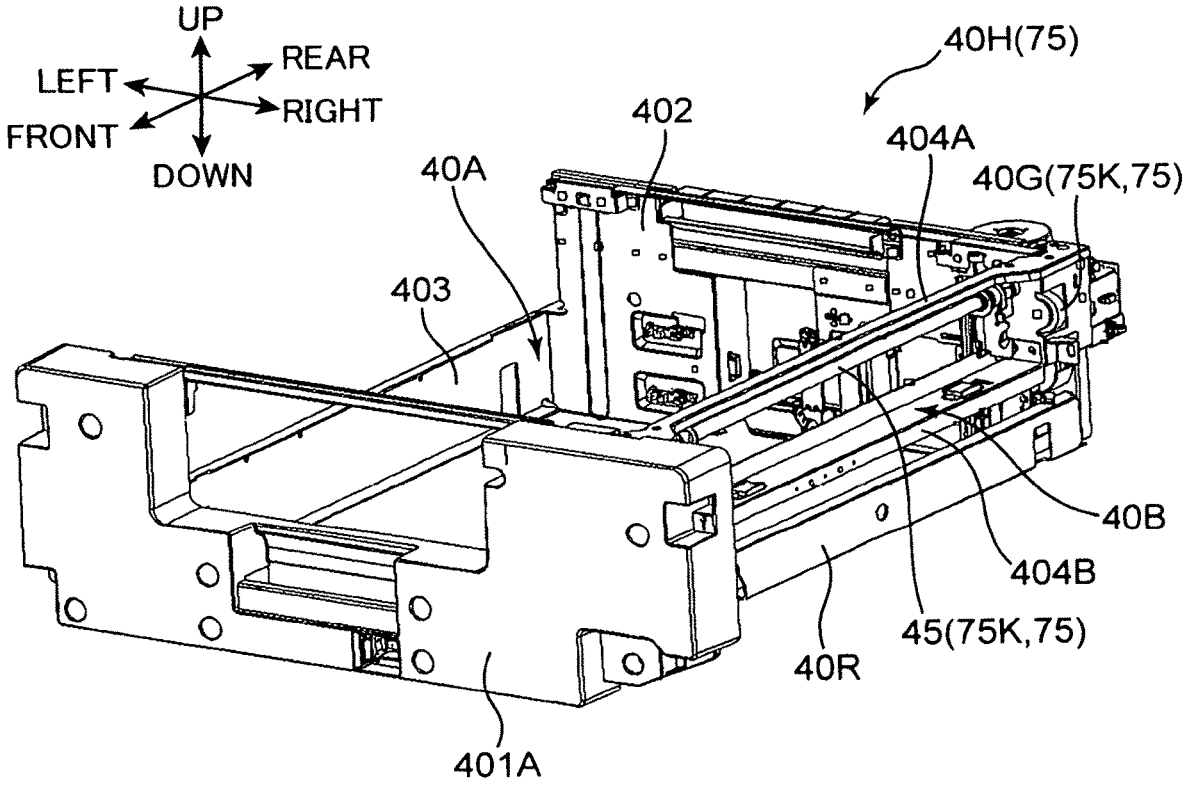
FIG. 14 is a perspective view of the conveyance unit frame.
Figure 15:
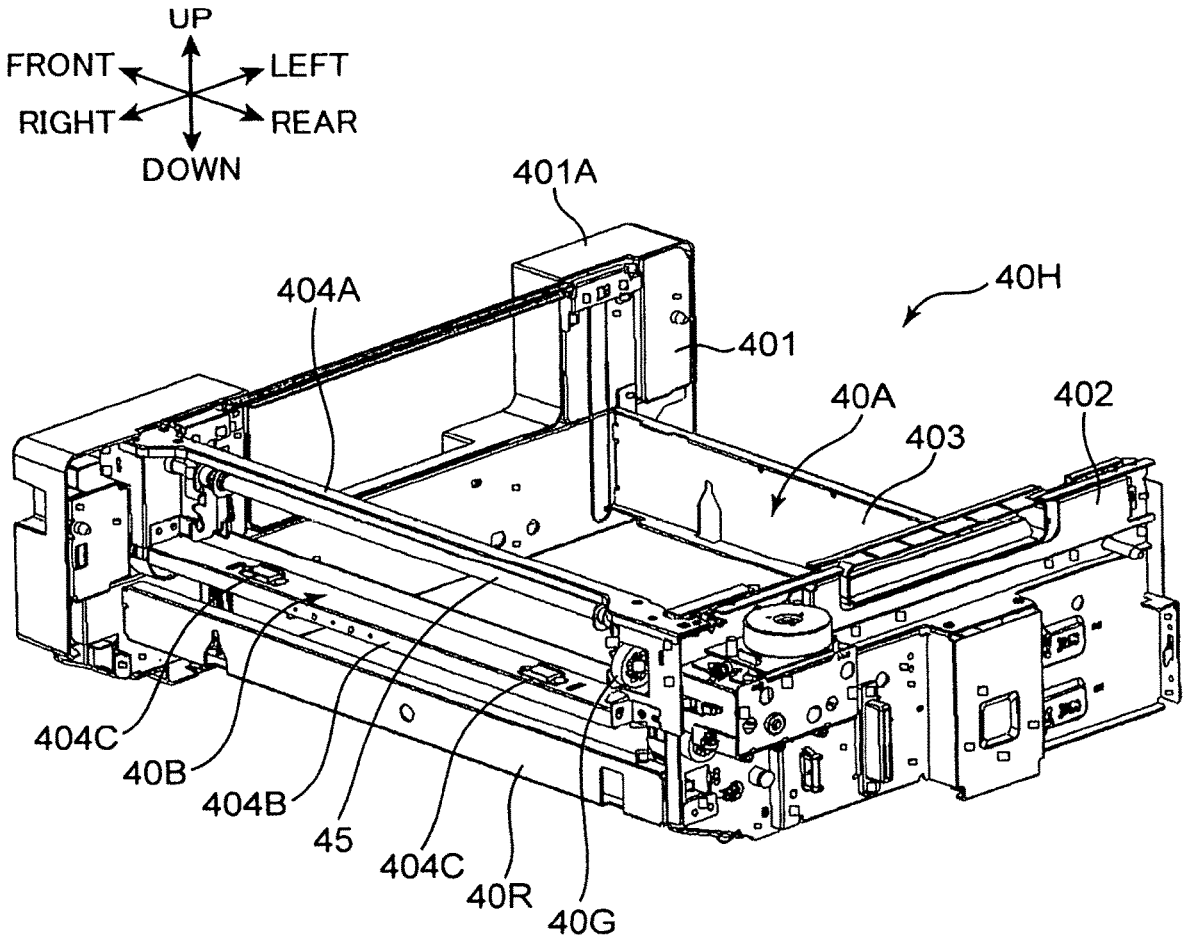
FIG. 15 is a perspective view of the conveyance unit frame.

FIG. 12 is a perspective view showing a state where a conveyance unit frame 40H is removed from a body frame 100 which forms the apparatus body 10 of the image forming apparatus 1 according to the present embodiment. FIG. 13 is a perspective view showing a state where the conveyance unit frame 40H is mounted on the body frame 100. FIGS. 14 and 15 are perspective views of the conveyance unit frame 40H.

The belt conveyance unit 40 (conveyance unit) shown in FIG. 1 further includes the conveyance unit frame 40H. The conveyance unit frame 40H integrally supports the conveyance belt 41, the first support roller 421, the second support roller 422, the third support roller 423, the pair of fourth support rollers 424, and the suction unit 43. The conveyance unit frame 40H can be mounted in the body frame 100 of the apparatus body 10 in a first direction (rearward direction) parallel to the front-rear direction (the axial direction of the resist lower roller 32), and can be removed from the body frame 100 along a second direction (frontward direction) opposite to the first direction.

With reference to FIGS. 14 and 15, the conveyance unit frame 40H includes a front frame 401, a rear frame 402, a left frame 403, a first right frame 404A (upper connection frame), a second right frame 404B (lower connection frame), a pair of front and rear magnets 404C (magnetic members), and a pair of left and right rail portions 40R.

The front frame 401 is a frame disposed on a front surface portion of the conveyance unit frame 40H. As shown in FIGS. 14 and 15, a front cover 401A is mounted on the front frame 401. The front cover 401A forms a part of the front surface portion of the apparatus body 10. The rear frame 402 is a frame disposed on a rear surface portion of the conveyance unit frame 40H, and is disposed so as to face the front frame 401 in the front-rear direction. The left frame 403 is disposed on a left end portion of the conveyance unit frame 40H, and connects the front frame 401 and the rear frame 402 to each other along the front-rear direction. The first right frame 404A and the second right frame 404B are disposed on the right end portion of the conveyance unit frame 40H, and connect the front frame 401 and the rear frame 402 to each other along the front-rear direction. The first right frame 404A is disposed along an upper surface portion of the conveyance unit frame 40H, and the second right frame 404B is disposed below the first right frame 404A. Both end portions of the first right frame 404A and both end portions of the second right frame 404B in the front-rear direction are respectively connected to each other along a vertical direction by a pair of side plates (not shown) which is disposed inside the front frame 401 and the rear frame 402. As a result, a rectangular frame structure is formed by the first right frame 404A, the second right frame 404B, and the above-described pair of side plates. The left and right rail portions 40R which form a pair are rail portions for allowing the conveyance unit frame 40H to move in a slidable manner in the front-rear direction with respect to the body frame 100. In FIGS. 14 and 15, only the right rail portion 40R is described. However, a similar rail portion 40R is disposed also at the left end portion of the conveyance unit frame 40H. The magnets 404C which form a pair are magnets disposed on an upper surface portion of the second right frame 404B at intervals in the front-rear direction. The pair of magnets 404C has a function of holding the cleaning unit 70.

As shown in FIGS. 14 and 15, a conveyance unit mounting portion 40A is formed, on the conveyance unit frame 40H, closer to the left side than the first right frame 404A and the second right frame 404B are. The conveyance belt 41, the first support roller 421, the second support roller 422, the third support roller 423, the pair of fourth support rollers 424, the suction unit 43, and the like are disposed in the conveyance unit mounting portion 40A. On the other hand, a cleaning unit mounting portion 40B (unit housing portion) is disposed in a space between the first right frame 404A and the second right frame 404B. The cleaning unit mounting portion 40B allows the above-described cleaning unit 70 disposed at the mounting and removing position to be mounted on the cleaning unit mounting portion 40B, and houses the cleaning unit 70. The cleaning unit mounting portion 40B forms a part of the movement mechanism 75.

Figure 16:
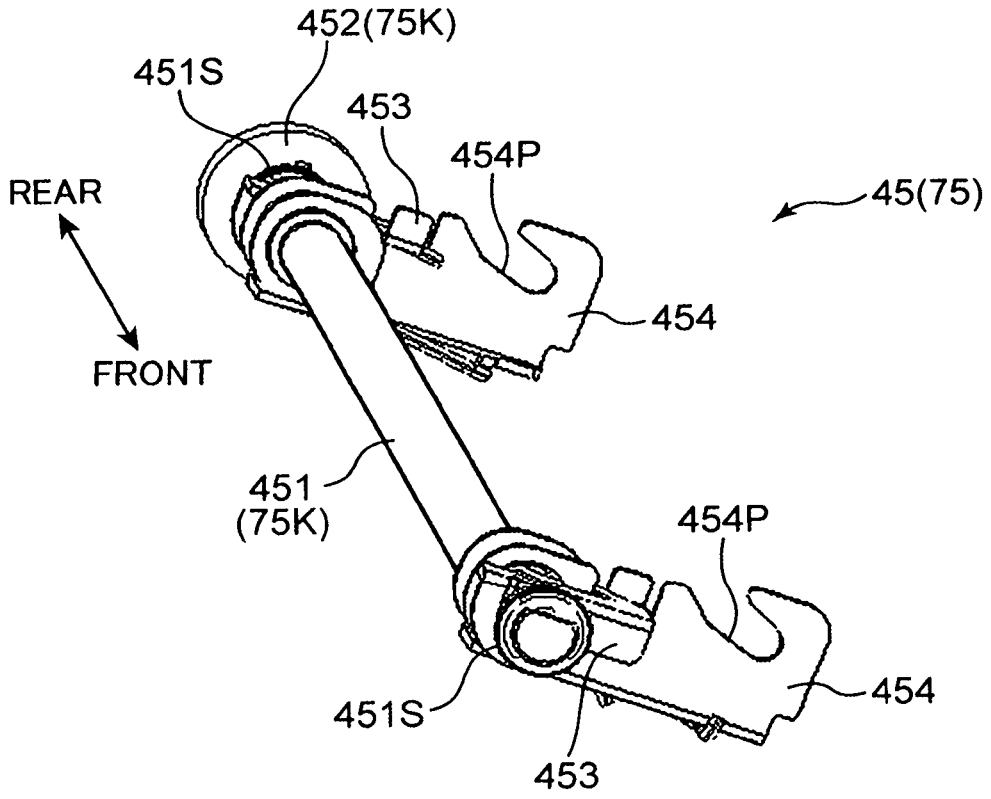
FIG. 16 is a perspective view of a cleaning unit rotating unit of the conveyance unit frame.
Figure 17:
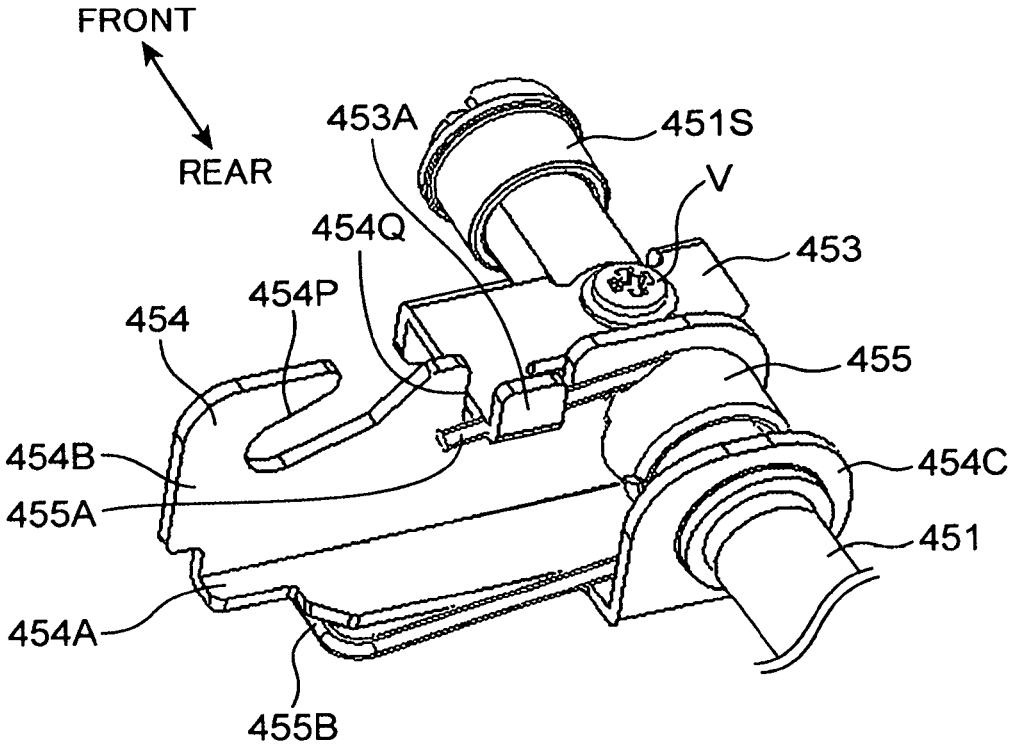
FIG. 17 is an enlarged perspective view showing a part of the cleaning unit rotating unit of the conveyance unit frame in an enlarged manner.
Figure 18:
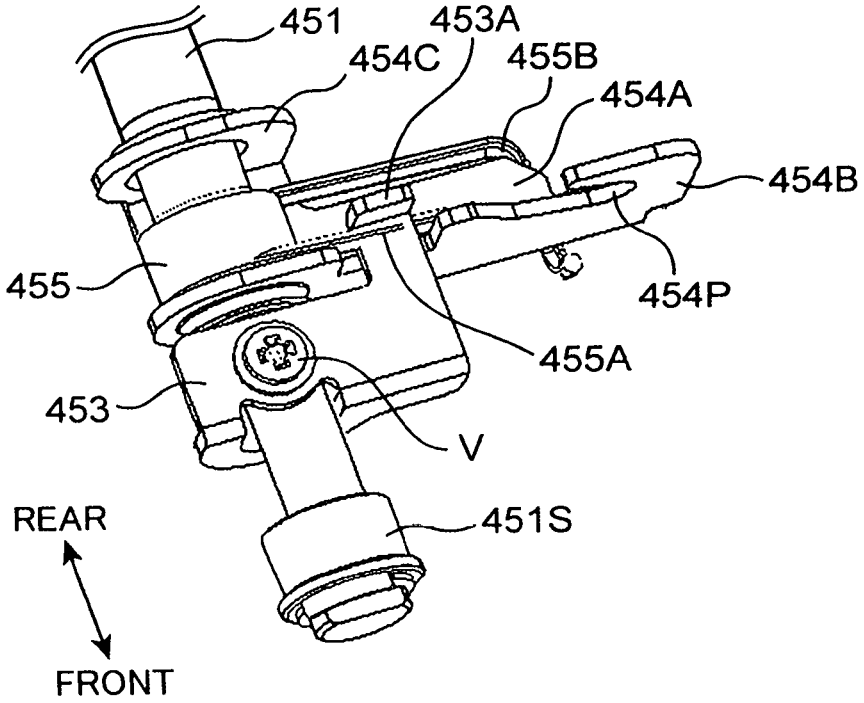
FIG. 18 is an enlarged perspective view showing a part of the cleaning unit rotating unit of the conveyance unit frame in an enlarged manner.

Further, the conveyance unit frame 40H has a cleaning unit rotating unit 45 and a rotation input gear 40G. FIG. 16 is a perspective view of the cleaning unit rotating unit 45 of the conveyance unit frame 40H according to the present embodiment. FIGS. 17 and 18 are enlarged perspective views showing a part of the cleaning unit rotating unit 45 in an enlarged manner.

As shown in FIGS. 14 and 15, the cleaning unit rotating unit 45 is supported by the pair of side plates just below the first right frame 404A. With reference to FIG. 16, the cleaning unit rotating unit 45 includes a rotary shaft 451, a pair of front and rear bearings 451S, a rotary gear 452, a pair of front and rear lever support portions 453 (fixing members), a pair of front and rear rotary levers 454 (support members), and a pair of front and rear coil springs 455 (spring members).

The rotary shaft 451 is rotatably supported by the pair of side plates by way of the pair of front and rear bearings 451S. The rotary shaft 451 extends along the front-rear direction (the axial direction of the resist lower roller 32) and forms a center axis (first center axis) in the rotation of the pair of rotary levers 454. The rotary gear 452 is a gear fixed to a rear end portion of the rotary shaft 451, and engages with the rotation input gear 40G.

The pair of front and rear rotary levers 454 is disposed in the cleaning unit mounting portion 40B, and can support the cleaning housing 70H so as to sandwich the cleaning housing 70H of the cleaning unit 70 from both sides in the front-rear direction (the axial direction of the resist lower roller 32). With reference to FIGS. 17 and 18, each rotary lever 454 has a lever bottom portion 454A, a first lever side portion 454B, and a second lever side portion 454C. The lever bottom portion 454A includes a surface parallel to the axial direction of the rotary shaft 451, and extends in a radial direction of the rotary shaft 451. The first lever side portion 454B and the second lever side portion 454C are wall portions raised from front and rear side edges of the lever bottom portion 454A, and are respectively disposed so as to be orthogonal to the axial direction of the rotary shaft 451. The second lever side portion 454C has a substantially rectangular shape slightly larger than an outer diameter of the rotary shaft 451, and the first lever side portion 454B extends longer in the radial direction from the rotary shaft 451 than the second lever side portion 454C does.

A hole through which the rotary shaft 451 is inserted is formed in the first lever side portion 454B and the second lever side portion 454C respectively. As a result, the rotary lever 454 is rotatably supported by the rotary shaft 451.

Further, a pin receiving portion 454P (shaft support portion) and a cutout portion 454Q are formed on the first lever side portion 454B. The pin receiving portion 454P has a shape obtained by cutting out a side edge of the first lever side portion 454B in an elongated hole shape. The pin receiving portions 454P have a function of receiving the unit fulcrum pin 70P (FIGS. 3 and 4) of the cleaning unit 70 along a direction orthogonal to the front-rear direction (the axial direction of the resist lower roller 32) and a function of rotatably supporting the unit fulcrum pin 70P. The cutout portion 454Q has a shape obtained by cutting out a side edge of the first lever side portion 454B in a substantially rectangular shape between the pin receiving portion 454P and the rotary shaft 451.

The pair of front and rear lever support portions 453 is fixed to the rotary shaft 451 by screws V such that the front and rear lever support portions 453 hold the pair of rotary levers 454 respectively. The lever support portion 453 has a support protruding portion 453A which is disposed so as to extend in the front-rear direction in the cutout portion 454Q. A distal end portion of the support protruding portion 453A has a shape where the distal end portion is bent orthogonally to a body portion of the lever support portion 453.

With reference to FIGS. 17 and 18, the pair of front and rear coil springs 455 is disposed so as to be interposed between the lever support portion 453 and the rotary lever 454 respectively. Specifically, each coil spring 455 has a first spring end portion 455A and a second spring end portion 455B. The first spring end portion 455A is engaged with an upper surface portion of the support protruding portion 453A. The second spring end portion 455B is engaged with a lower surface portion of the lever bottom portion 454A of the rotary lever 454. As a result, each coil spring 455 is interposed between the rotary lever 454 and the lever support portion 453 in an elastically deformable manner such that the rotary lever 454 can rotate relative to the lever support portion 453 within a predetermined allowable angle range about the center axis (first center axis) of the rotary shaft 451. When an external force is not applied to the lever support portion 453 and the rotary lever 454, the relative position between the lever support portion 453 and the rotary lever 454 in a circumferential direction (rotation direction) is restricted by an elastic force of the coil spring 455. In other words, in FIGS. 17 and 18, when the position of the rotary lever 454 is fixed, the lever support portion 453 and the rotary shaft 451 can rotate relative to the rotary lever 454 while elastically deforming the coil spring 455.

Further, the cleaning device 7 has a rotation drive unit 75K. The rotation drive unit 75K forms a part of the movement mechanism 75. The rotation drive unit 75K rotates the pair of rotary levers 454 about the center axis (first center axis) of the rotary shaft 451 such that the cleaning unit 70 moves between the cleaning position and the mounting and removing position in a state where the pair of unit fulcrum pins 70P is pivotally supported by the pair of pin receiving portions 454P. The center axis is disposed above the pin receiving portion 454P in FIG. 2. Further, the rotation drive unit 75K rotates the pair of rotary levers 454 while allowing the pair of unit fulcrum pins 70P to rotate relative to the pair of pin receiving portions 454P such that the cleaning unit 70 maintains an orientation where the cleaning part 70A (web W) of the cleaning unit 70 faces upward.

The rotation drive unit 75K has a unit driving unit 80 (FIG. 2) (driving unit) in addition to the above-described cleaning unit rotating unit 45. The unit driving unit 80 generates a drive force for rotating the rotary shaft 451 of the cleaning unit rotating unit 45 about the center axis of the rotary shaft 451.

Figure 24:
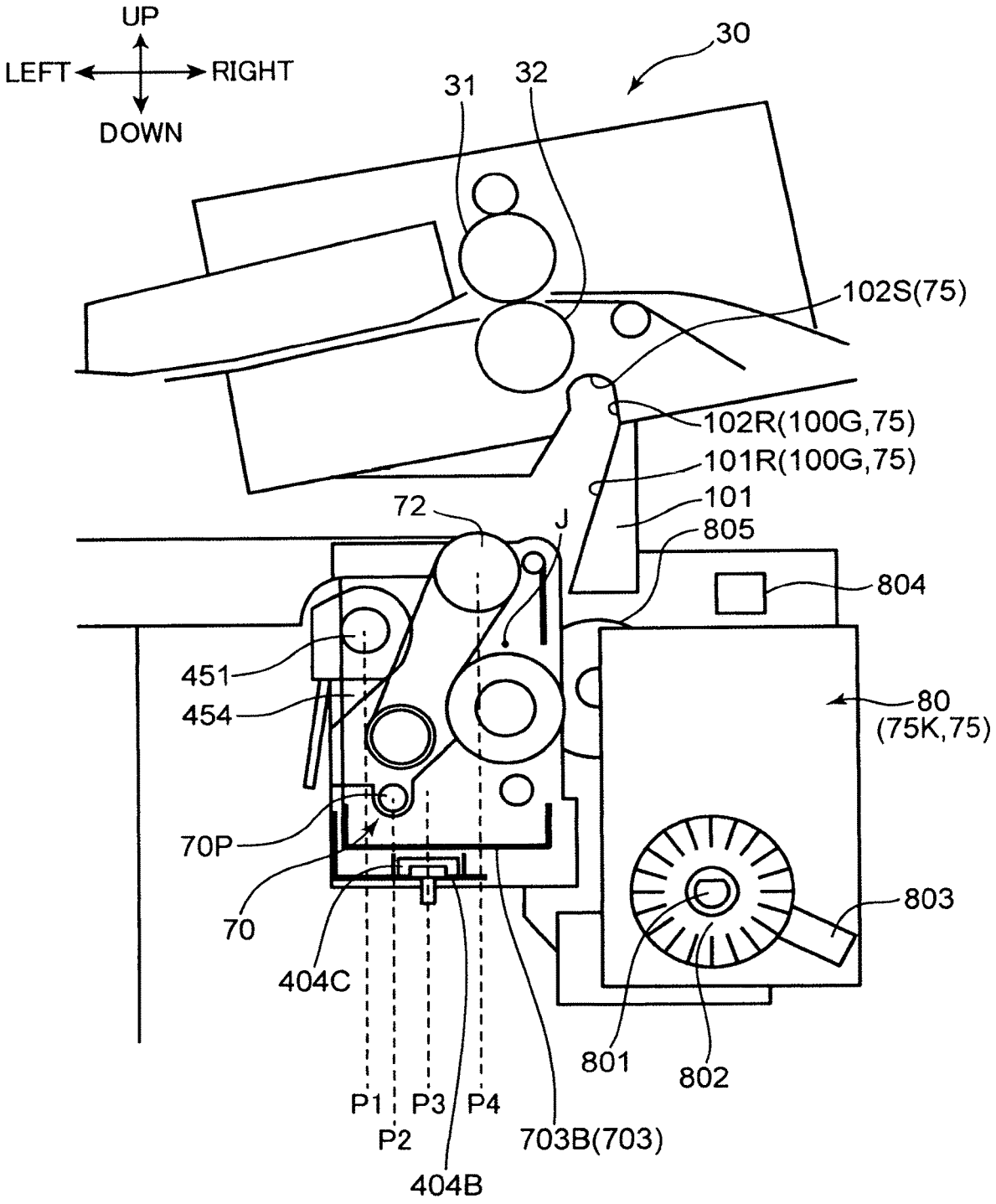
FIG. 24 is a cross-sectional view of a pair of resist rollers, a cleaning unit of an image forming apparatus and the surrounding of these parts according to an embodiment of the present disclosure, and is also a cross-sectional view showing a state where the cleaning unit is disposed at a mounting and removing position.

With reference to FIG. 2, the unit driving unit 80 includes a motor (not shown) including a drive motor output shaft 801, a pulse plate 802, a first detection sensor 803, a second detection sensor 804, and a unit drive output gear 805 (FIG. 24). The rotational driving of the motor is controlled by the above-described controller 90.

The pulse plate 802 is fixed to the drive motor output shaft 801, and rotates integrally with the drive motor output shaft 801. The first detection sensor 803 detects a rotation amount of the pulse plate 802. Specifically, the first detection sensor 803 includes a light emitting part for emitting detection light, and a light receiving part for receiving the detection light. A plurality of slits which open at intervals along the rotation direction of the pulse plate 802 are formed in the pulse plate 802. Along with the rotation of the pulse plate 802, the detection light is blocked by the slits, and the light receiving part outputs a signal corresponding to a waveform of the detection light to the controller 90 and hence, a rotation amount of the drive motor output shaft 801 (the pair of rotary levers 454) is detected.

The second detection sensor 804 is formed of a publicly known PI sensor, and detects that the cleaning unit 70 is disposed at the cleaning position shown in FIG. 2. In the present embodiment, when a part of the cleaning housing 70H of the cleaning unit 70 enters between the light emitting part and the light receiving part of the second detection sensor 804, the second detection sensor 804 detects the cleaning unit 70.

The unit drive output gear 805 transmits a rotational drive force generated by the motor of the unit driving unit 80 to the rotation input gear 40G of the cleaning unit rotating unit 45. In the present embodiment, when the conveyance unit frame 40H is mounted on the body frame 100, the rotation input gear 40G and the unit drive output gear 805 engage with each other, and a rotational drive force can be transmitted.

Figure 19:
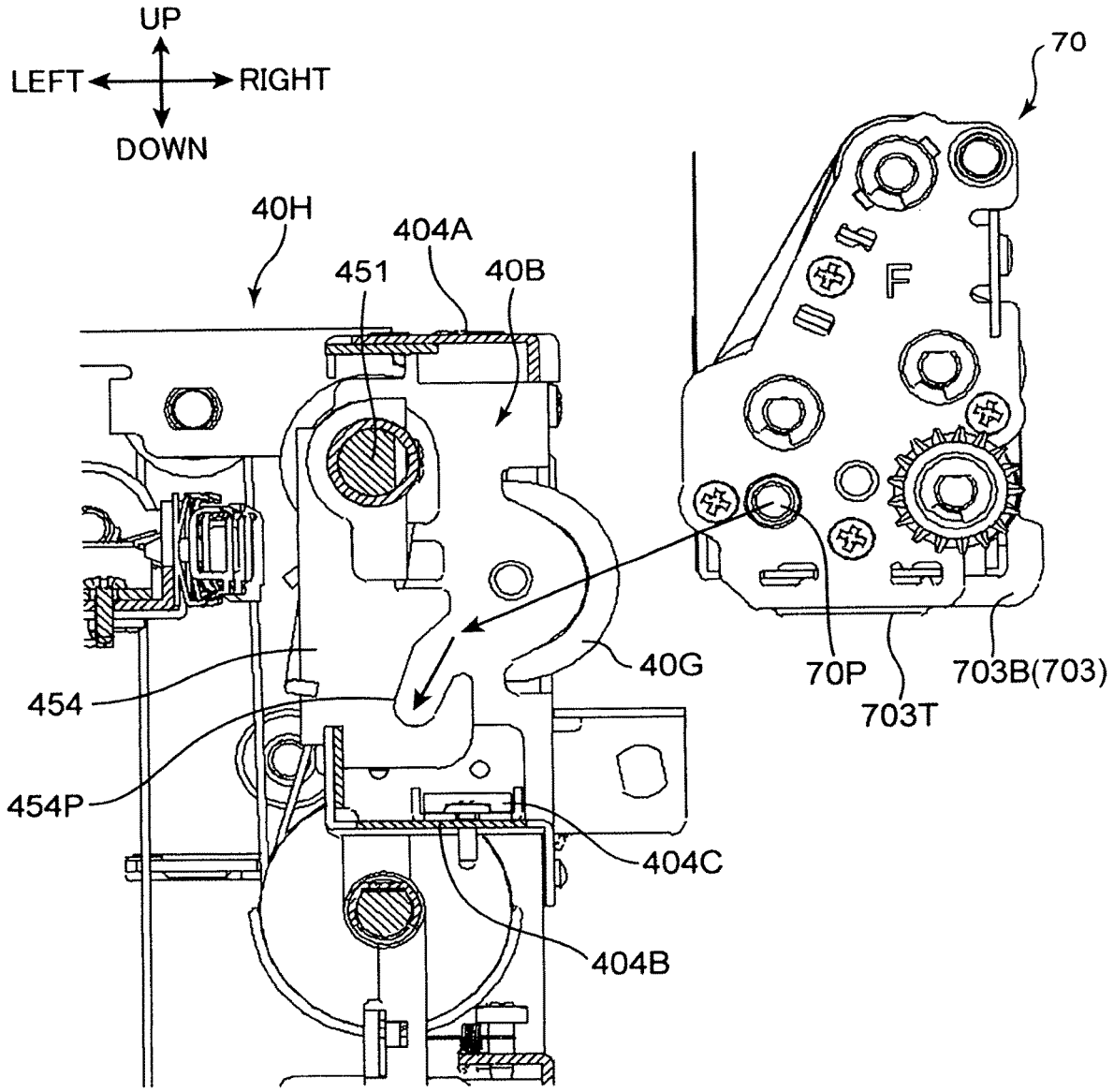
FIG. 19 is a cross-sectional view showing a state where the cleaning unit is to be mounted on the conveyance unit frame.
Figure 20:
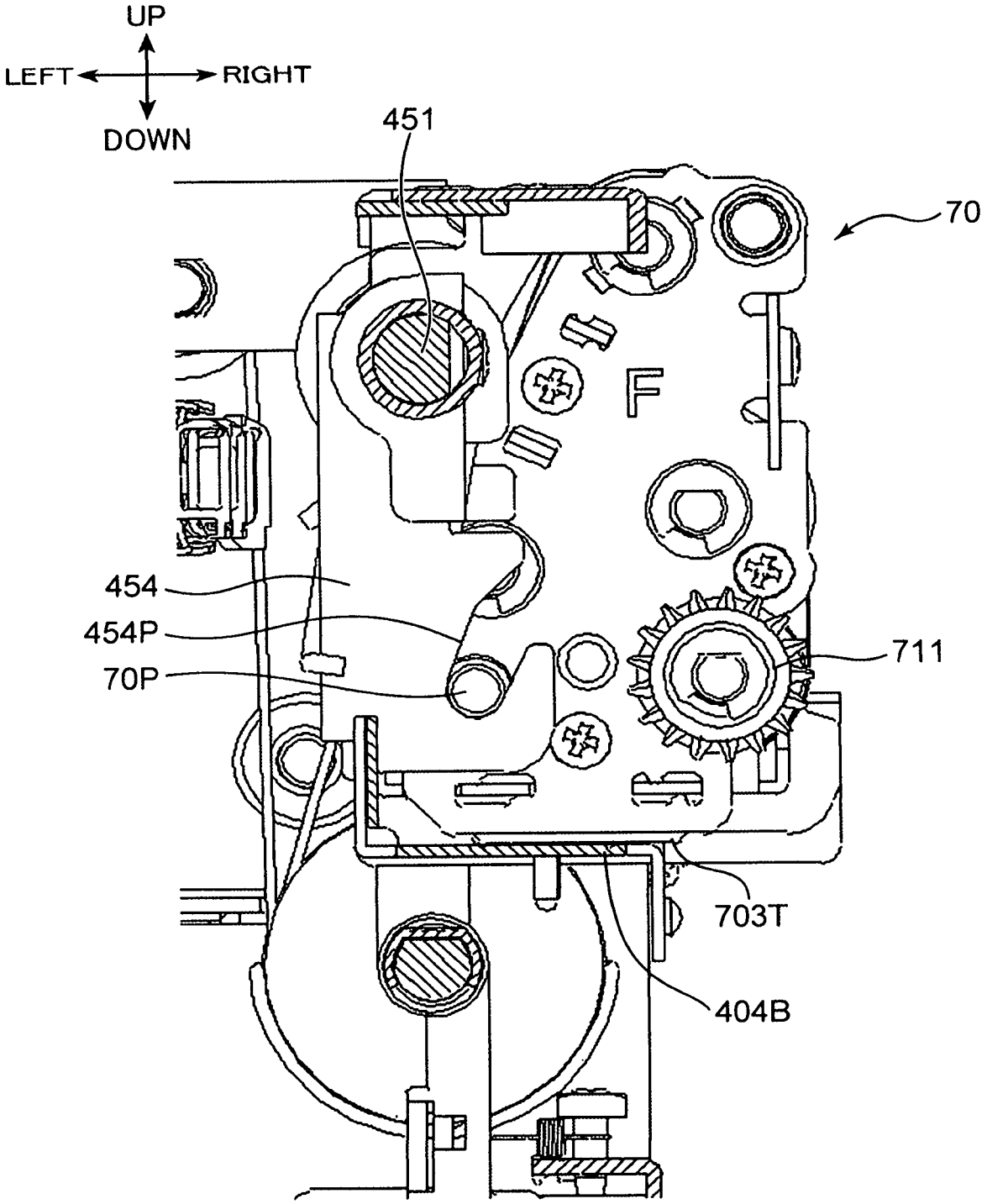
FIG. 20 is a cross-sectional view showing a state where the cleaning unit is mounted on the conveyance unit frame.
Figure 21:
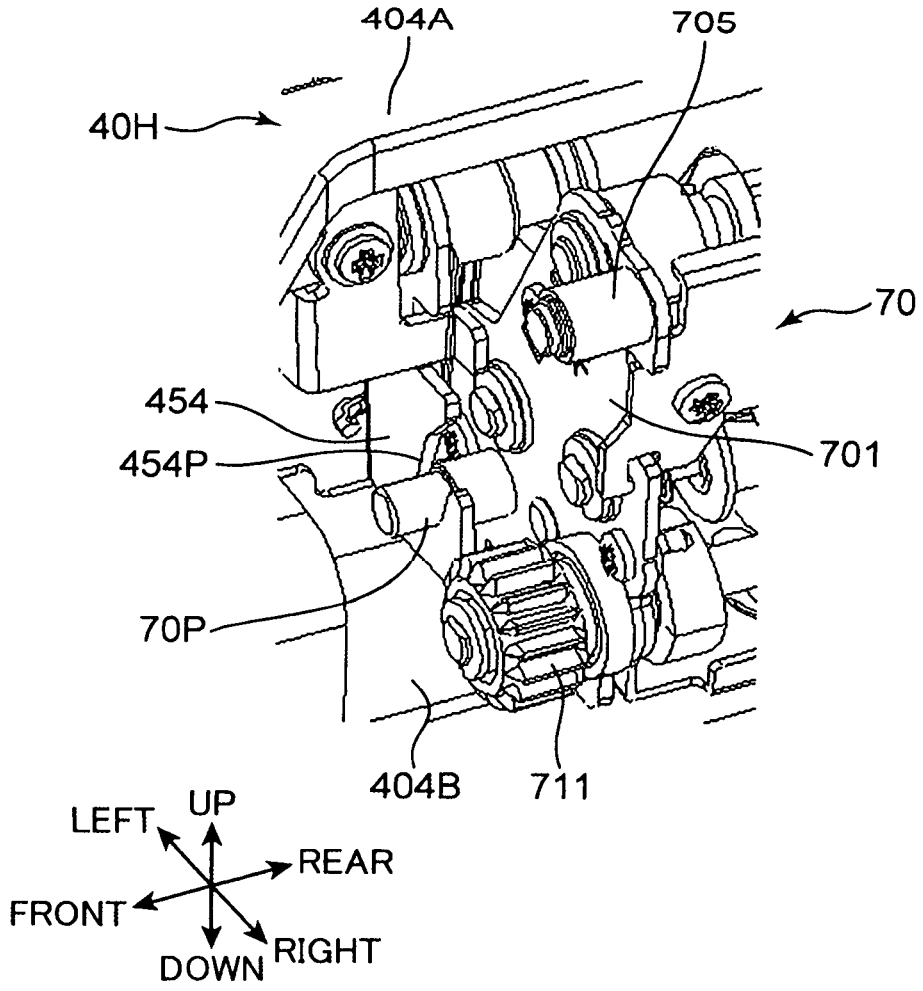
FIG. 21 is an enlarged perspective view showing a state where the cleaning unit is mounted on the conveyance unit frame.
Figure 22:
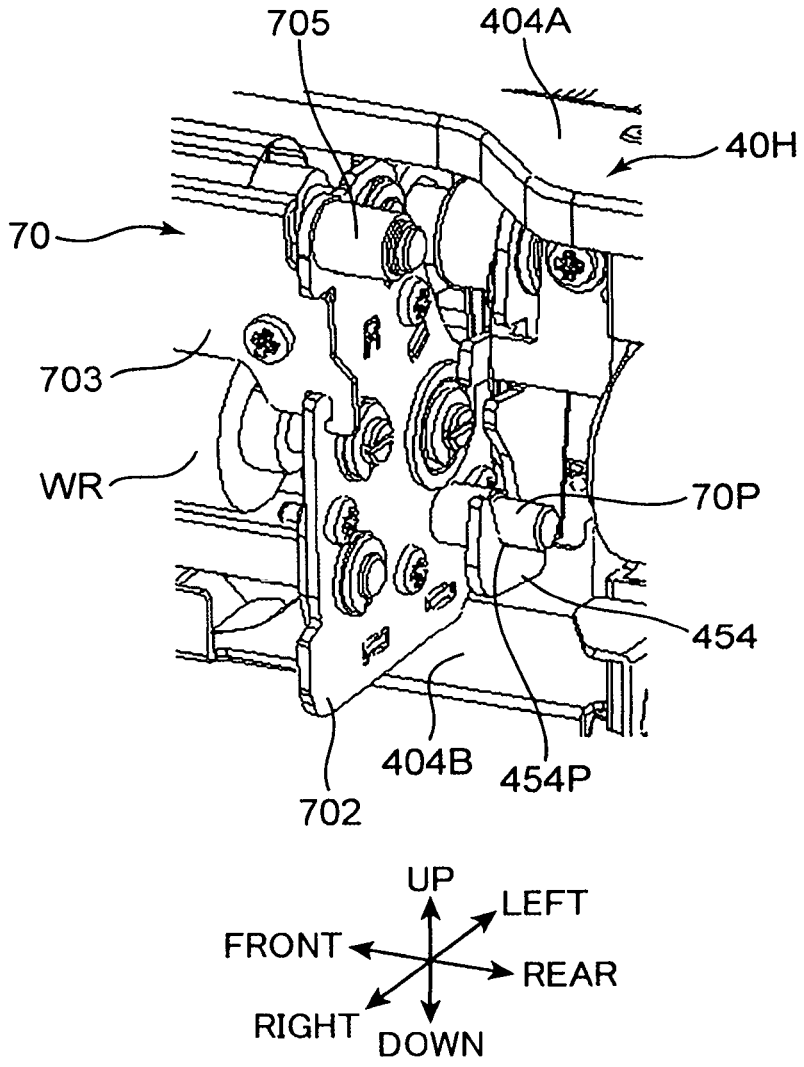
FIG. 22 is an enlarged perspective view showing a state where the cleaning unit is mounted on the conveyance unit frame.
Figure 23:
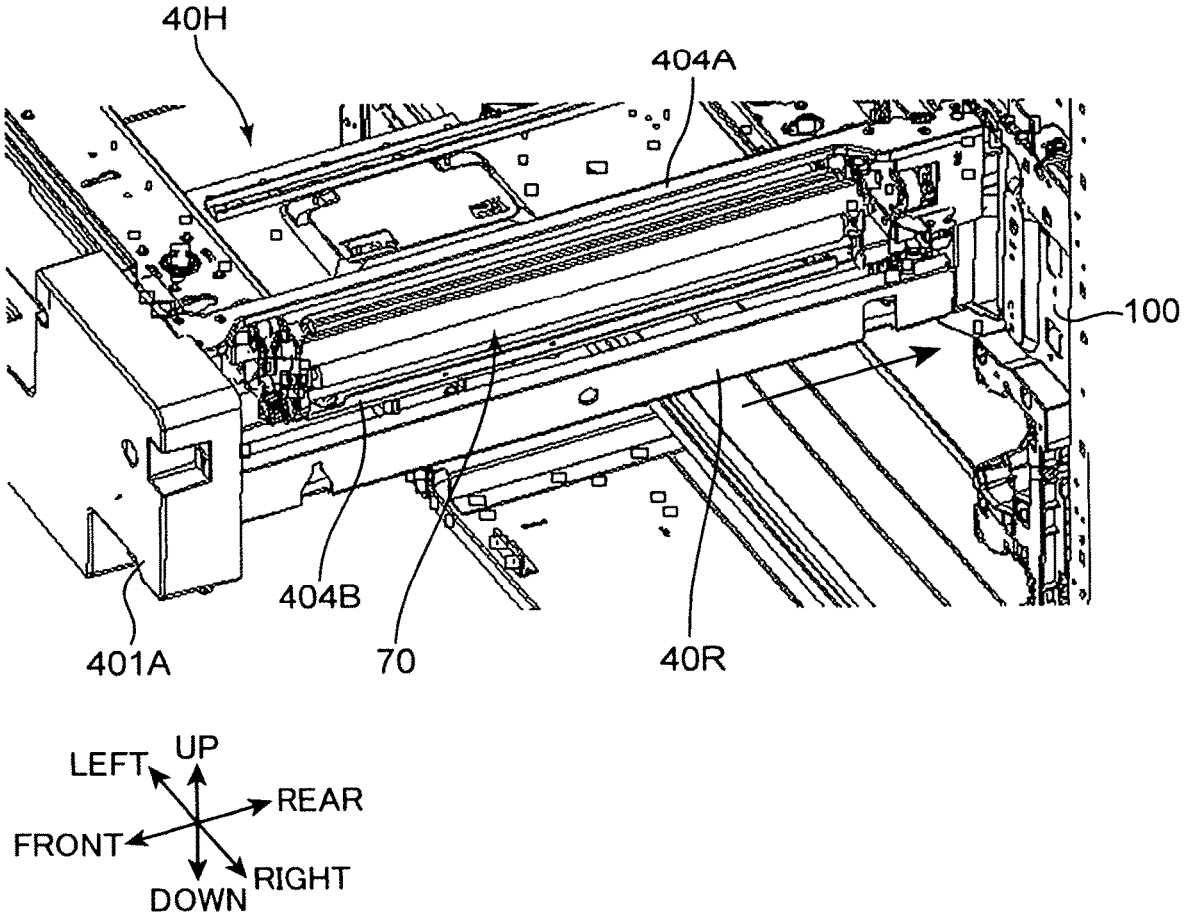
FIG. 23 is a perspective view showing a state where the cleaning unit is mounted on the conveyance unit frame.
Figure 25:
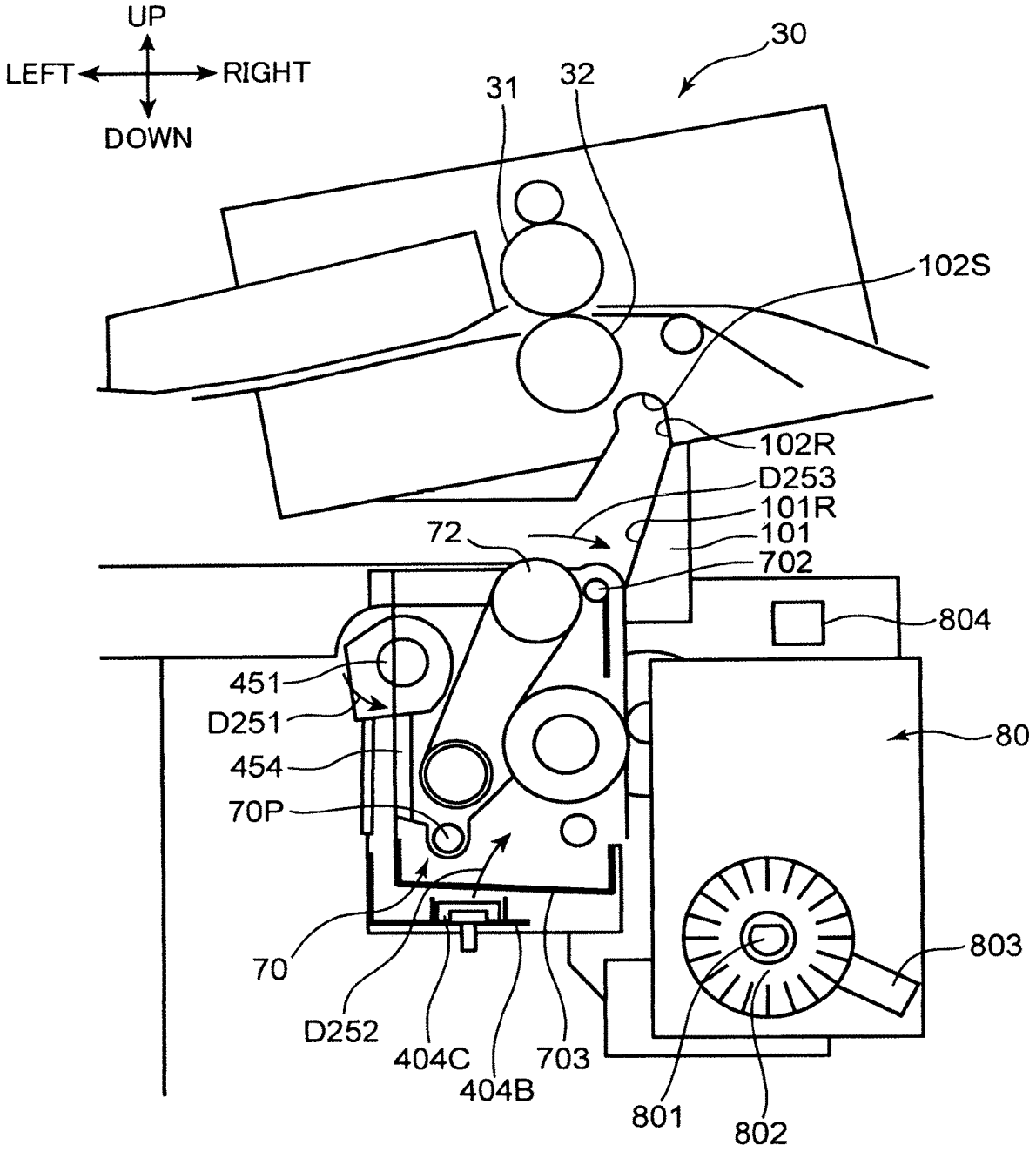
FIG. 25 is a cross-sectional view showing a state where the cleaning unit is slightly pushed up from the mounting and removing position.
Figure 27:
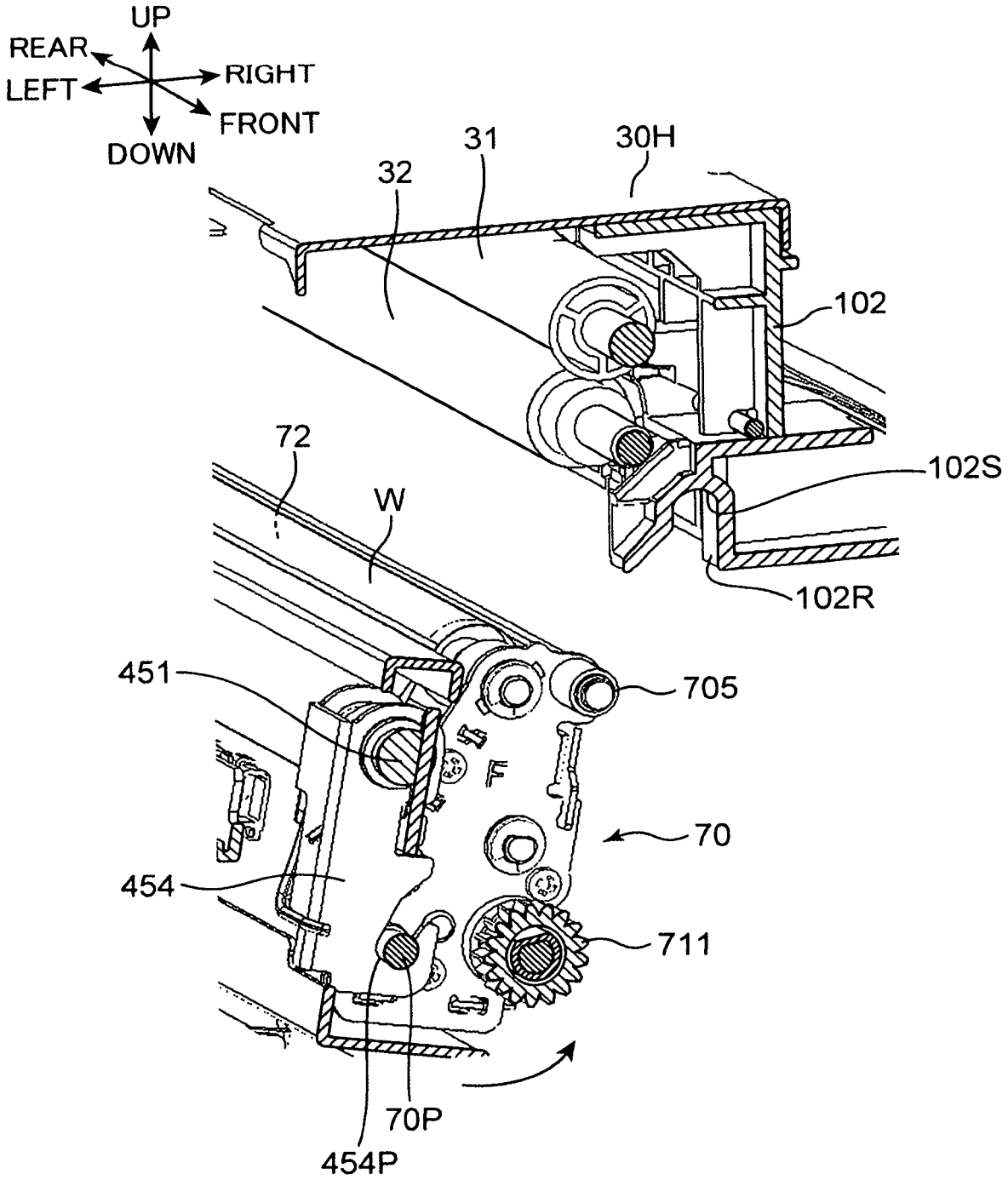
FIG. 27 is a cross-sectional perspective view showing a state where the cleaning unit is disposed at the mounting and removing position.
Figure 28:
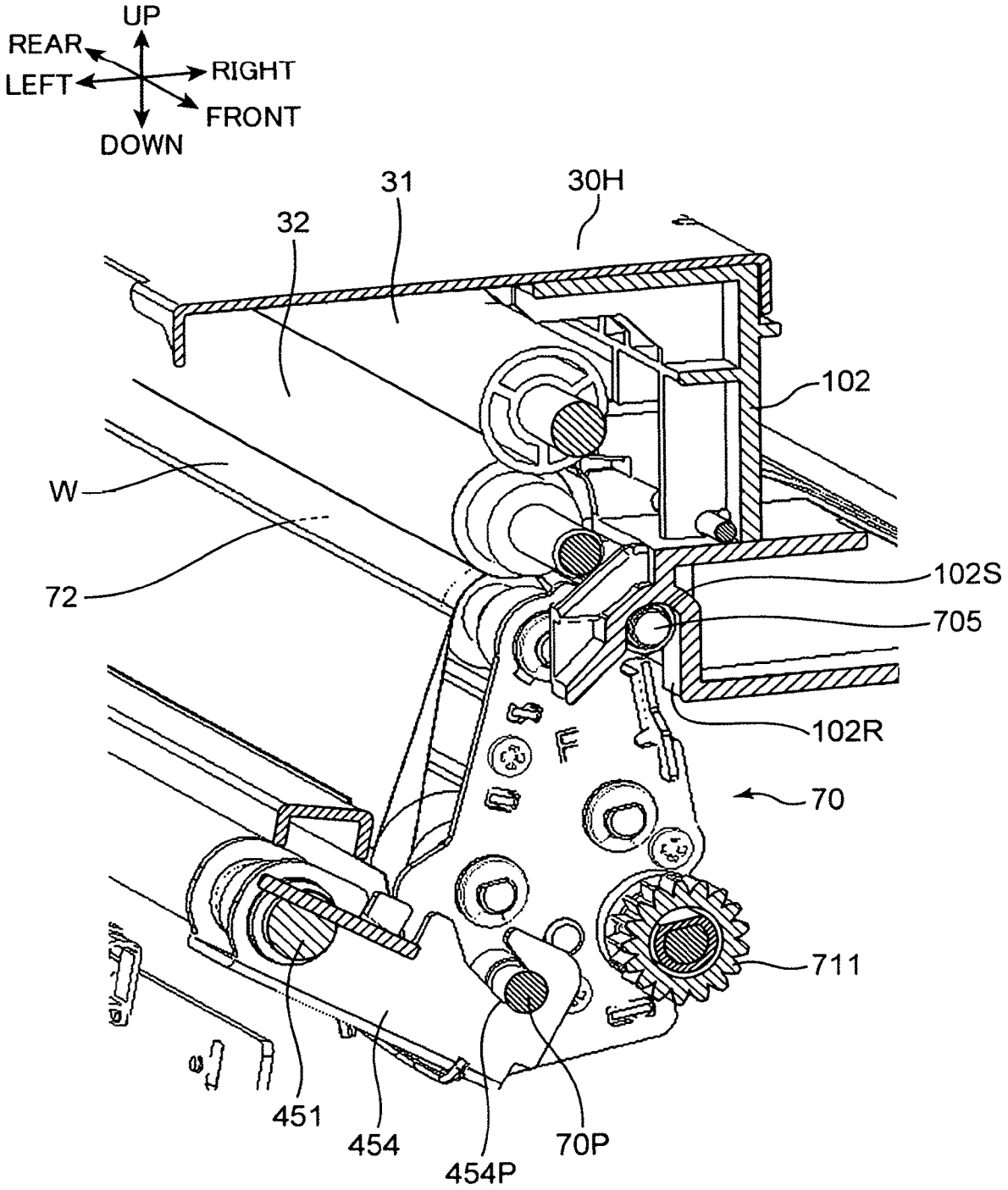
FIG. 28 is a cross-sectional perspective view showing a state where the cleaning unit is disposed at a cleaning position.
Figure 29:
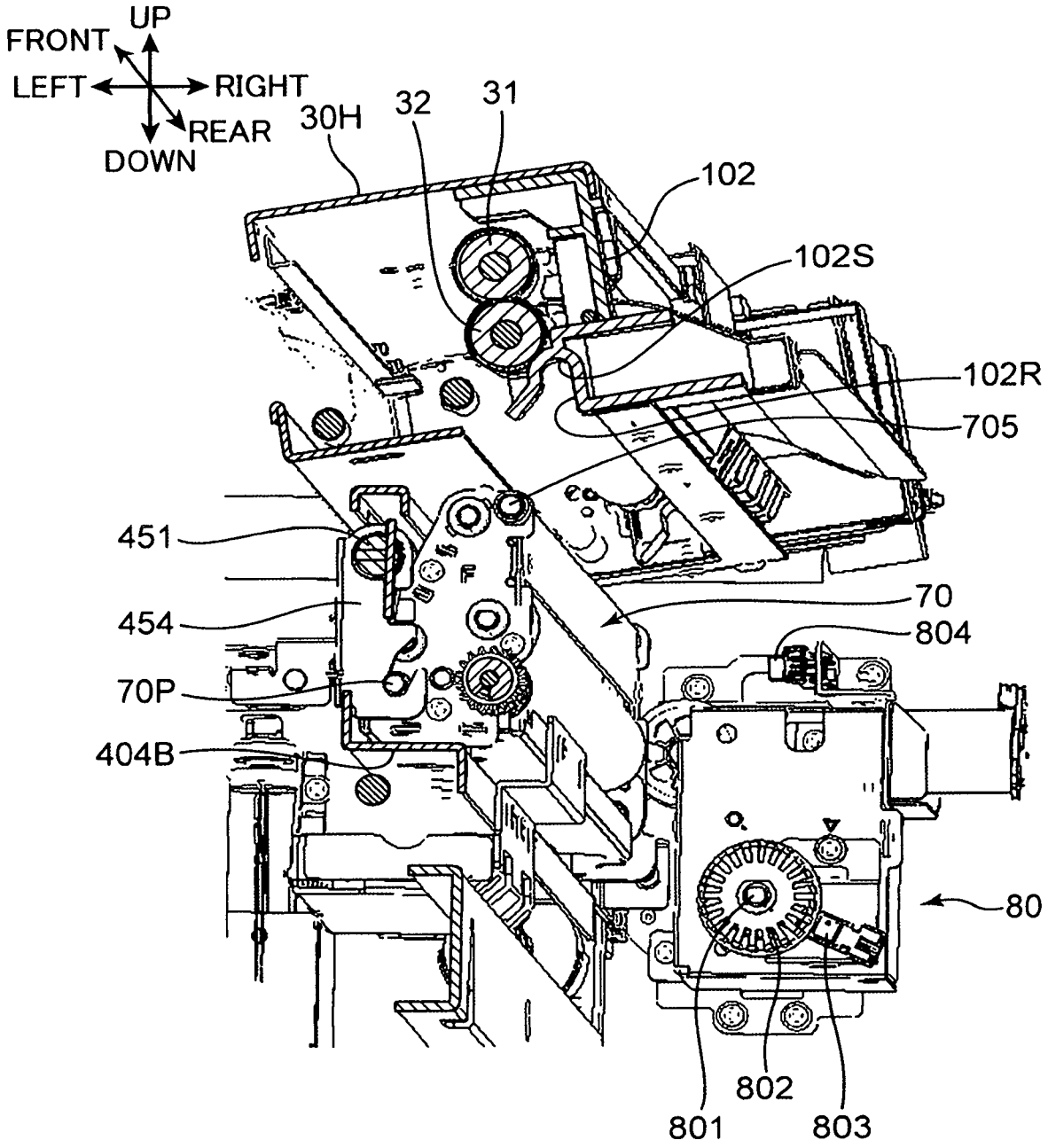
FIG. 29 is a cross-sectional perspective view showing a state where the cleaning unit is disposed at the mounting and removing position.
Figure 30:
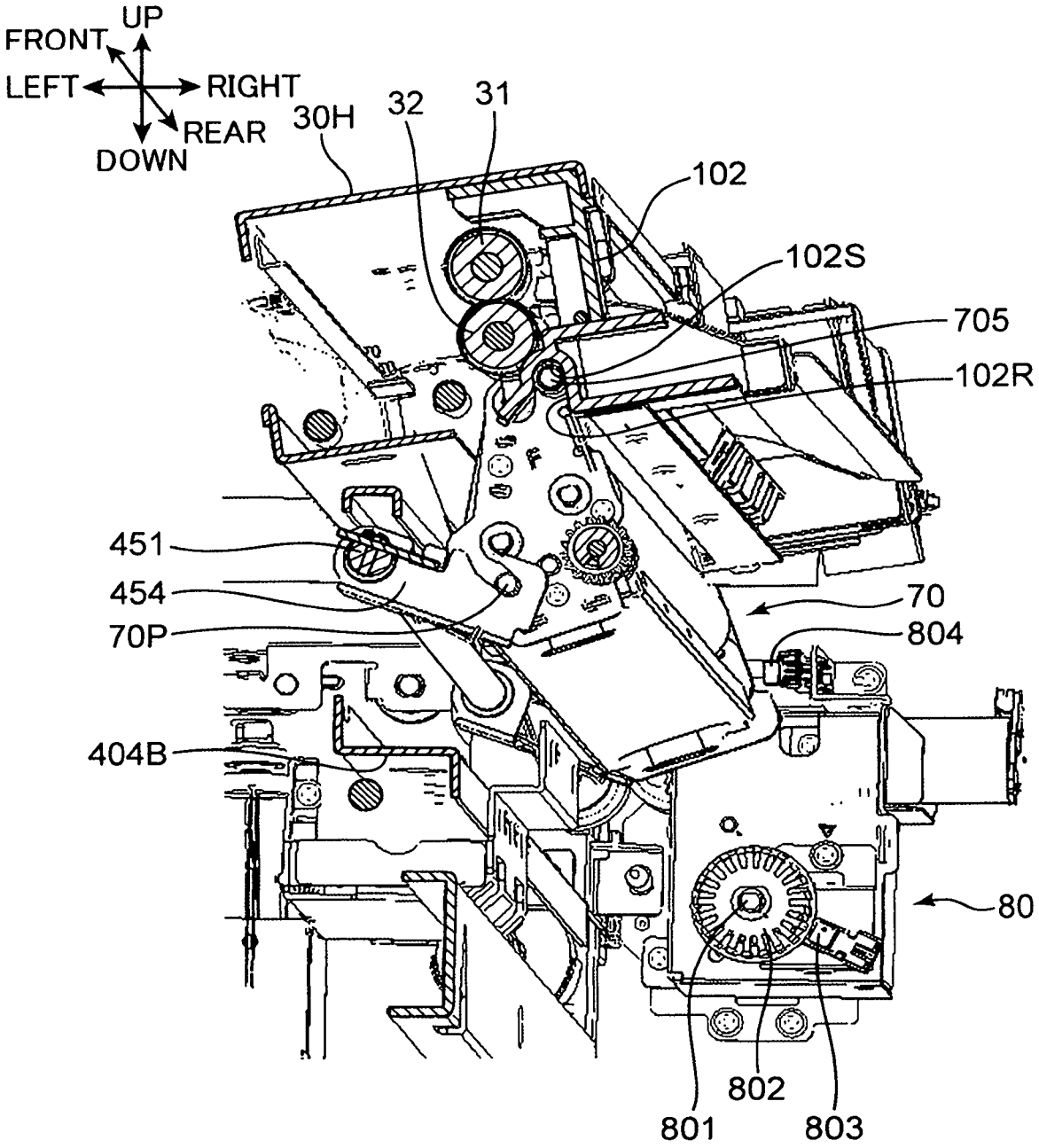
FIG. 30 is a cross-sectional perspective view of a pair of resist rollers and a cleaning unit of an image forming apparatus according to an embodiment of the present disclosure, and is also a cross-sectional perspective view showing a state where the cleaning unit is disposed at a cleaning position.
Figure 31:
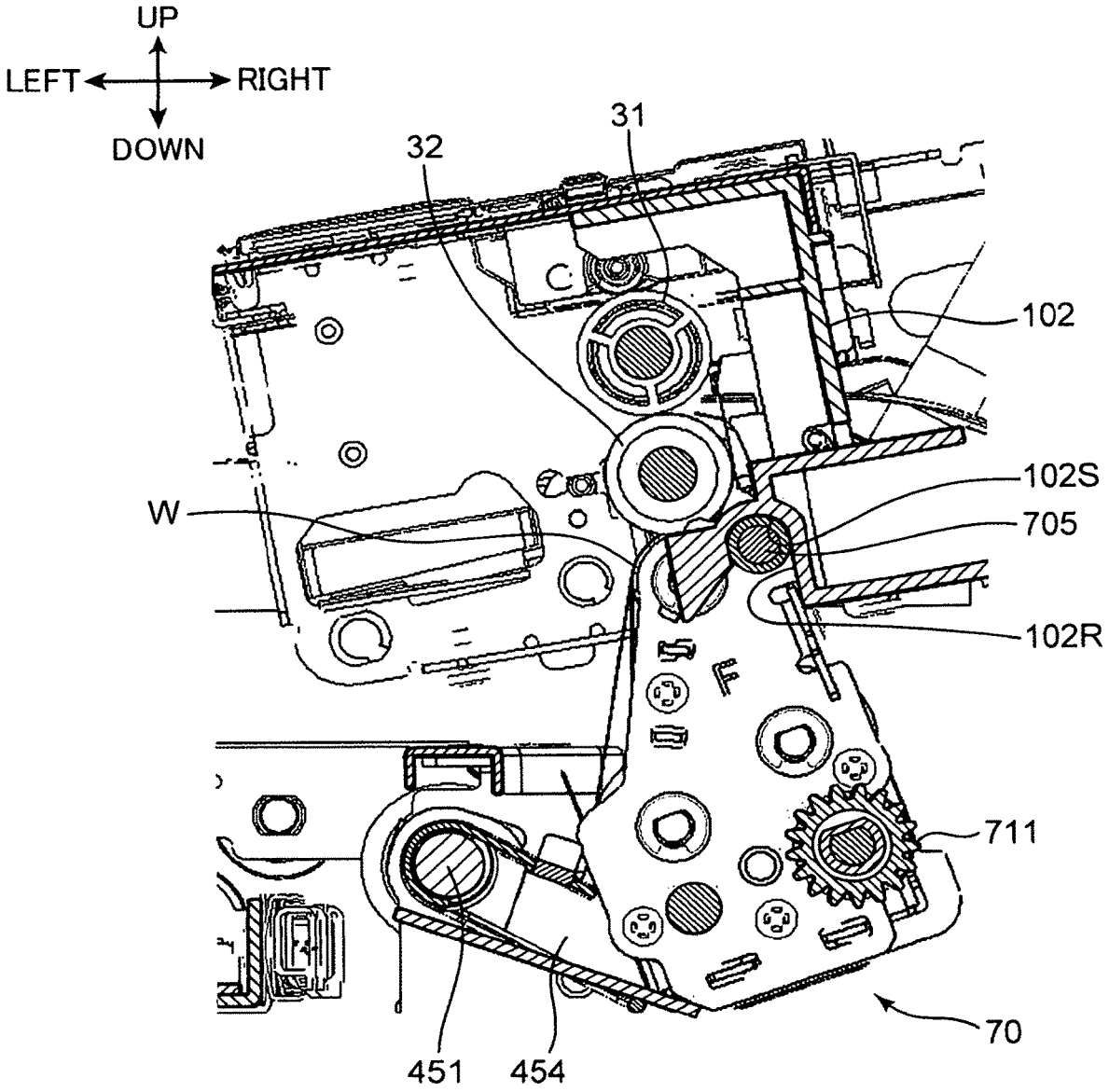
FIG. 31 is a cross-sectional view of a pair of resist rollers and a cleaning unit of an image forming apparatus according to an embodiment of the present disclosure, and is also a cross-sectional view showing a state where the cleaning unit is disposed at a cleaning position.

FIG. 19 is a cross-sectional view showing a state where the cleaning unit 70 is to be mounted on the conveyance unit frame 40H according to the present embodiment, and FIG. 20 is a cross-sectional view showing a state where the cleaning unit 70 is mounted on the conveyance unit frame 40H. FIGS. 21 and 22 are enlarged perspective views each showing a state where the cleaning unit 70 is mounted on the conveyance unit frame 40H. FIG. 23 is a perspective view showing a state where the cleaning unit 70 is mounted on the conveyance unit frame 40H. FIG. 24 is a cross-sectional view of the pair of resist rollers, the cleaning unit 70 of the image forming apparatus 1 and the surrounding of these parts, and is also a cross-sectional view showing a state where the cleaning unit 70 is disposed at the mounting and removing position. FIG. 25 is a cross-sectional view showing a state where the cleaning unit 70 is slightly pushed up from the mounting and removing position. FIG. 26 is a cross-sectional view of the pair of resist rollers, the cleaning unit 70 of the image forming apparatus and the surrounding of these parts, and is also a cross-sectional view showing a state where the cleaning unit 70 is disposed at the separation position. FIG. 27 is a cross-sectional perspective view showing a state where the cleaning unit 70 is disposed at the mounting and removing position. FIG. 28 is a cross-sectional perspective view showing a state where the cleaning unit 70 is disposed at the cleaning position. FIG. 29 is a cross-sectional perspective view showing a state where the cleaning unit 70 is disposed at the mounting and removing position. FIG. 30 is a cross-sectional perspective view showing a state where the cleaning unit 70 is disposed at the cleaning position. FIG. 31 is a cross-sectional view showing a state where the cleaning unit 70 is disposed at the cleaning position.

With reference to FIG. 24, the movement mechanism 75 further includes a guide portion 100G. The guide portion 100G allows the pair of guide rollers 705 to be brought into contact with the guide portions 100G along with the rotation of the pair of rotary levers 454 about the first center axis, and guides the cleaning unit 70 between the cleaning position and the mounting and removing position. The guide portion 100G has a pair of front and rear first guide surfaces 101R and a pair of front and rear second guide surfaces 102R. The pair of front and rear first guide surfaces 101R is formed of left side surfaces of a pair of front and rear guide frames 101 which the body frame 100 includes. The first guide surface 101R is inclined such that the first guide surface 101R guides the cleaning unit 70 (guide roller 705) rightward as the first guide surface 101R extends upward. In the same manner, the pair of front and rear second guide surfaces 102R is formed of parts of a pair of front and rear resist frames 102 (FIG. 27) which the body frame 100 includes. The second guide surface 102R is slightly inclined such that the second guide surface 102R guides the cleaning unit 70 (guide roller 705) leftward as the second guide surface 102R extends upward.

The movement mechanism 75 has a pair of front and rear positioning portions 102S. The positioning portion 102S is brought into contact with the guide roller 705 of the cleaning unit at the cleaning position and thus positioning the cleaning unit 70 such that the web W of the cleaning part 70A can clean the resist lower roller 32. As shown in FIG. 24, the positioning portion 102S is connected to the second guide surface 102R, and has an arc shape which extends along an outer peripheral surface of the guide roller 705. In FIG. 24, with respect to the pair of front and rear first guide surfaces 101R, the pair of front and rear second guide surfaces 102R, and the pair of front and rear positioning portions 102S, the respective members on a rear side are shown.

As shown in FIG. 12, when the conveyance unit frame 40H is pulled out frontward from the body frame 100 of the apparatus body 10, an operator can mount the cleaning unit 70 on the cleaning unit mounting portion 40B of the conveyance unit frame 40H. At this stage of the operation, as shown in FIG. 19, the pair of rotary levers 454 is disposed so as to extend downward from the rotary shaft 451 (first center axis). The pin receiving portion 454P has a shape obtained by cutting out a side portion on a right side (one end side in a width direction) of the rotary lever 454 obliquely leftward (toward the other end side opposite to the one end side in the width direction) and downward. Accordingly, the operator can insert and fit the pair of left and right unit fulcrum pins 70P of the cleaning unit 70 into the pin receiving portions 454P from above while holding the side wall 703A and the bottom wall 703B (FIG. 6) of the cleaning unit 70 (FIG. 20). At this stage of the operation, the above-described unit input gear 711 is disposed behind the unit fulcrum pin 70P on a front side of the cleaning unit 70 (FIG. 21). As shown in FIG. 22, the unit fulcrum pin 70P on a rear side of the cleaning unit 70 is fitted into the pin receiving portion 454P.

When the pair of unit fulcrum pins 70P of the cleaning unit 70 is fitted into the pin receiving portions 454P of the pair of rotary levers 454 by the operator, the bottom wall 703B of the cleaning housing 70H is disposed so as to face the pair of magnets 404C, and the pair of ribs 703T is respectively brought into contact with the upper surface portion of the second right frame 404B. As a result, in addition to the pair of rotary levers 454, the cleaning unit 70 is held by the second right frame 404B by a magnetic field generated by the pair of magnets 404C. Accordingly, even when the operator leaves his hand from the cleaning unit 70, it is possible to prevent the cleaning unit 70 from being removed from the conveyance unit frame 40H.

As described above, when the cleaning unit 70 is mounted on the cleaning unit mounting portion 40B (mounting and removing position) of the conveyance unit frame 40H, the operator inserts the conveyance unit frame 40H into the body frame 100 (FIG. 23). As a result, the cleaning unit 70 is inserted into the body frame 100, and the rotation input gear 40G of the conveyance unit frame 40H engages with the unit drive output gear 805 of the unit driving unit 80 in the body frame 100. At this stage of the operation, the pair of front and rear guide rollers 705 of the cleaning unit 70 is disposed so as to face the first guide surfaces 101R of the pair of front and rear guide portions 100G at predetermined intervals in the left-right direction.

As shown in FIG. 24, when the cleaning unit 70 disposed at the mounting and removing position is viewed from a direction parallel to the axial direction of the resist lower roller 32, a center (P2) of the unit fulcrum pin 70P supported by the pin receiving portion 454P is disposed below a center axis (P1) of the rotary shaft 451 and on a right side (one end side in the width direction) of the center axis (P1) of the rotary shaft 451. A center of gravity (J) of the cleaning unit 70 is disposed on a right side of the unit fulcrum pin 70P. In the present embodiment, a shaft of the pressing roller 72 of the cleaning unit 70 is made of metal (for example, a SUS material having a diameter of 10 mm) and a surface of the pressing roller 72 is formed of a sponge roller made of EPDM. Accordingly, as shown in FIG. 24, the center of gravity of the cleaning unit 70 is offset to a right side portion of the cleaning unit 70 so as to be positioned more on a right side than a center (P4) of the pressing roller 72. Further, a center (P3) of the magnet 404C in the left-right direction (width direction) is disposed on a right side (distal end side in a moving direction of the cleaning unit 70 in the left-right direction) of the center (P2) of the unit fulcrum pin 70P.

The controller 90 controls the unit driving unit 80 from the state shown in FIG. 24, and the rotation drive unit 75K rotates the pair of rotary levers 454 about the rotary shaft 451 (indicated by arrow D251 in FIG. 25). At this stage of the operation, a left end portion of the bottom wall 703B moves upward along with the movement of the unit fulcrum pin 70P (indicated by arrow D252 in FIG. 25). As a result, a distance between the left end portion of the bottom wall 703B and the magnet 404C is increased and hence, an effect of a magnetic restraining force generated by the magnet 404C becomes small whereby the bottom wall 703B of the cleaning unit 70 can be easily removed from the magnet 404C. Then, when the cleaning unit 70 tilts rightward about the unit fulcrum pin 70P due to its own weight (indicated by arrow D253 in FIG. 25), the pair of guide rollers 705 is brought into contact with the first guide surfaces 101R of the pair of guide portions 100G respectively. In FIG. 25, since the guide roller 705 is hidden behind the rear wall 702, the contact portion between the guide roller 705 and the first guide surface 101R is not visible. However, in the actual structure, the guide roller 705 is brought into contact with the first guide surface 101R in a state shown in FIG. 25.

Then, when the controller 90 further rotates the pair of rotary levers 454, the cleaning unit 70 moves upward and rightward while the pair of guide rollers 705 is guided by the first guide surface 101R. At this stage of operation, a rotation trajectory of the rotary lever 454 and a movement trajectory of the cleaning unit 70 guided by the first guide surface 101R are different from each other. In the present embodiment, the pair of unit fulcrum pins 70P of the cleaning unit 70 is supported by the pin receiving portion 454P of the rotary lever 454 so as to be rotatable relative to the pin receiving portion 454P. Accordingly, as shown in FIGS. 25 and 26, the orientation of the cleaning unit 70 can be changed along with the upward movement of the cleaning unit 70 and hence, the cleaning unit 70 can smoothly rise corresponding to the rotation of the rotary lever 454.

In a state shown in FIG. 26, the pair of guide rollers 705 is transferred from the first guide surfaces 101R to the second guide surfaces 102R. Then, when the controller 90 further rotates the rotary lever 454, the pair of guide rollers 705 is brought into contact with and is fitted in the pair of positioning portions 102S (FIG. 31). At this stage of the operation, as shown in FIG. 2, the pressing roller 72 of the cleaning part 70A of the cleaning unit 70 is brought into contact with the resist lower roller 32 from below along the straight line L which connects the center of the resist upper roller 31 and the center of the resist lower roller 32 to each other. At this stage of the operation, the rotary lever 454 extends obliquely downward from the rotary shaft 451 so as to intersect with the vertical direction at an acute angle (see FIG. 28). Accordingly, it is possible to prevent the unit fulcrum pin 70P from being removed from the pin receiving portion 454P. When the cleaning unit 70 reaches the cleaning position shown in FIGS. 2, 28, 30 and 31 respectively in this manner, the pressing roller 72 presses the web W to the resist lower roller 32 and hence, pigment, paper dust, and the like adhering to the surface of the resist lower roller 32 can be removed by cleaning. In the orientation of the cleaning unit 70 disposed at the cleaning position shown in FIG. 2, the center of gravity (the pressing roller 72) of the cleaning unit 70 is disposed just above the unit fulcrum pin 70P and hence, the orientation of the cleaning unit 70 at the cleaning position can be maintained in a stable manner. Further, the controller 90 can, by continuously applying an excitation current to the motor of the unit driving unit 80, hold the cleaning unit 70 at the cleaning position with no reverse rotation of the rotary lever 454. In another embodiment, the cleaning device 7 may further include a lock mechanism for locking the cleaning unit 70 at the cleaning position, and a lock release mechanism for allowing the cleaning unit 70 to move from the cleaning position to the mounting and removing position by releasing locking of the cleaning unit 70.

As described above, in the present embodiment, the cleaning device 7 includes the cleaning unit 70 and the movement mechanism 75, and cleans the surface of the resist lower roller 32. The movement mechanism 75 is capable of moving the cleaning unit 70 at least between the cleaning position and the mounting and removing position. Accordingly, when the movement mechanism 75 disposes the cleaning unit 70 at the cleaning position, the cleaning part 70A of the cleaning unit 70 can clean the resist lower roller 32. On the other hand, when the movement mechanism 75 disposes the cleaning unit 70 at the mounting and removing position below the cleaning position, the cleaning part 70A is disposed below the resist lower roller 32 in a separated manner so that the cleaning unit 70 can be mounted on and removed from the apparatus body 10. As a result, the cleaning unit 70 can be removed from the apparatus body 10 without applying a large load to the resist lower roller 32. Further, it is possible to move the cleaning unit 70 between the mounting and removing position and the cleaning position only by rotating the pair of rotary levers 454 about the rotary shaft 451 (first center axis) using the rotation drive unit 75K. At this stage of operation, the pair of unit fulcrum pins 70P rotates relative to the pair of pin receiving portions 454P and hence, the cleaning unit 70 can maintain an orientation of the pressing roller 72 (web W) of the cleaning part 70A that the pressing roller 72 faces upward. Accordingly, at the same time that the cleaning unit 70 which has reached the cleaning position is brought into contact with the positioning portion 102S, the pressing roller 72 of the cleaning part 70A can be brought into contact with the resist lower roller 32 from below.

In the present embodiment, the cleaning housing 70H has the pair of guide rollers 705. Accordingly, the cleaning unit 70 can be guided in a stable manner between the mounting and removing position and the cleaning position using the pair of guide rollers 705 and the pair of guide portions 100G corresponding to the rotation of the pair of rotary levers 454 by the rotation drive unit 75K.

With reference to FIG. 2, in the present embodiment, the resist lower roller 32 is disposed at the position below the resist upper roller 31 and the position displaced to a right side (upstream in a conveyance direction of the sheet S) with respect to the resist upper roller 31. As a result, the sheet S can be stably conveyed toward the image forming position disposed at the position lower than the pair of resist rollers.

On the other hand, the cleaning unit mounting portion 40B mounted on the conveyance unit frame 40H is positioned below the pair of resist rollers and on a left side (downstream in the sheet conveyance direction) with respect to the pair of resist rollers. In moving the cleaning unit 70 from the mounting and removing position disposed in the cleaning unit mounting portion 40B to the cleaning position just below the resist lower roller 32, in order to bring the pressing roller 72 into contact with the resist lower roller 32 along a straight line L which connects the center of the resist upper roller 31 and the center of the resist lower roller 32 to each other, a complicated movement mechanism is usually required. Particularly, in order to move the cleaning unit 70 linearly, it is necessary to linearly move the cleaning unit 70 to an intermediate position closer to the right side than the mounting and removing position and, thereafter, to move the cleaning unit 70 upward and leftward along the straight line L from the intermediate position. In this case, a plurality of linear movement paths which intersect with each other are required.

On the other hand, in the present embodiment, the movement of the cleaning unit 70 between the mounting and removing position and the cleaning position as described above is realized by the rotation of the pair of rotary levers 454 and a guide function by the guide portions 100G. Particularly, the rotary lever 454 moves the cleaning unit 70 rightward and upward from the mounting and removing position to the cleaning position. On the other hand, in guiding the guide rollers 705 of the cleaning unit 70 upward, the pair of guide portions 100G is disposed such that the movement trajectory of the pressing roller 72 of the cleaning unit 70 is different from the rotation trajectory of the rotary lever 454, to be more specific, such that the pressing roller 72 reaches the resist lower roller 32 with the shorter trajectory. Further, in order to prevent the cleaning unit 70 from coming into contact with the resist lower roller 32 along the straight line L and obstructing the rotation of the rotary lever 454, the unit fulcrum pin 70P of the cleaning unit 70 is allowed to rotate relative to the rotary lever 454 during the rotation of the rotary lever 454. With such a configuration, in a limited space formed below the pair of resist rollers, the cleaning unit 70 can be moved between the mounting and removing position and the cleaning position, and the pressing roller 72 can be brought into contact with and removed from the resist lower roller 32 along the straight line L. Further, the cleaning unit mounting portion 40B mounted on the conveyance unit frame 40H can be disposed closer to the left side (on a side of belt conveyance unit 40) than the pair of resist rollers is without being disposed just below the pair of resist rollers. Accordingly, the cleaning unit mounting portion 40B can be disposed in a limited space adjacent to the conveyance unit mounting portion 40A in the conveyance unit frame 40H and hence, the conveyance unit frame 40H can be made compact.

In the present embodiment, the rotary lever 454 has the pin receiving portion 454P for receiving the unit fulcrum pin 70P. Then, the rotation drive unit 75K moves the cleaning unit 70 to the cleaning position by rotating the pair of rotary levers 454 about the rotary shaft 451 such that the unit fulcrum pin 70P moves rightward and upward from a state where the cleaning unit 70 is disposed at the mounting and removing position. With such a configuration, at the mounting and removing position, the pair of unit fulcrum pins 70P of the cleaning unit 70 can be easily taken out from and inserted into the pin receiving portions 454P of the pair of rotary levers 454 in the direction orthogonal to the axial direction. Further, in a state where the pair of unit fulcrum pins 70P is fitted into the pair of pin receiving portions 454P by the own weight of the cleaning unit 70, the cleaning unit 70 can be moved in a stable manner to the cleaning position above the mounting and removing position.

In the present embodiment, when the rotation drive unit 75K rotates the pair of rotary levers 454 about the rotary shaft 451 at the mounting and removing position, the cleaning unit 70 tilts by its own weight, and the pair of guide rollers 705 is brought into contact with the pair of guide portions 100G respectively. Accordingly, the cleaning unit 70 can be stably and smoothly moved from the mounting and removing position to the cleaning position without requiring an additional drive mechanism for bringing the pair of guide rollers 705 into contact with the pair of guide portions 100G.

In the present embodiment, at least one magnet 404C is disposed on the second right frame 404B. Accordingly, the removal of the cleaning unit 70 from the cleaning unit mounting portion 40B can be suppressed by a magnetic binding force of the magnet 404C.

Further, the center of the magnet 404C in the left-right direction is disposed closer to the right side (downstream side in the moving direction of the cleaning unit 70) than the center of the unit fulcrum pins 70P supported by the pin receiving portion 454P is. Therefore, when the rotation drive unit 75K rotates the pair of rotary levers 454, the bottom wall 703B of the cleaning unit 70 tilts and hence, an effect of the magnetic binding force of the magnet 404C exerted on the bottom wall 703B is lowered. As a result, the cleaning unit 70 can be easily moved toward the cleaning position.

Further, in the present embodiment, the cleaning unit rotating unit 45 includes the pair of coil springs 455. Therefore, even when the unit driving unit 80 rotates the rotary shaft 451 after the cleaning unit 70 is brought into contact with the positioning portion 102S, it is possible to suppress applying of a large load to the pair of lever support portions 453. As a result, the necessity of controlling with high accuracy a driving amount of the unit driving unit 80 for allowing the cleaning unit 70 to reach the cleaning position is reduced.

Further, in the present embodiment, the surface of the resist lower roller 32 can be cleaned by the strip-shaped web W. Further, even when the surface of the web W is stained, the web driven roller 71 feeds out the web W due to the rotation of the web drive roller 73, and the surface of the resist lower roller 32 can be cleaned with a new contact surface.

Further, in the present embodiment, when the cleaning unit mounting portion 40B is disposed on the conveyance unit frame 40H and the cleaning unit 70 is disposed at the mounting and removing position, the cleaning unit 70 becomes mountable on and removable from the apparatus body 10 integrally with the belt conveyance unit 40. Accordingly, the cleaning unit 70 can be easily mounted on and removed from the apparatus body together with mounting and removing of the belt conveyance unit 40 on and from the apparatus body 10 for conveying the sheet S.

In the present embodiment, the conveyance unit frame 40H includes the first right frame 404A and the second right frame 404B. Accordingly, a rigidity of a right side portion of the conveyance unit frame 40H can be highly maintained. Further, the cleaning unit mounting portion 40B can be formed by making use of a space below the first right frame 404A (space between the first right frame 404A and the second right frame 404B). The rotation drive unit 75K rotates the pair of rotary levers 454 about the rotary shaft 451 such that the cleaning unit 70 is pulled out from the cleaning unit mounting portion 40B rightward (horizontal direction orthogonal to the axial direction of the resist lower roller 32) and reaches the cleaning position above the first right frame 404A. Accordingly, although an upper portion of the cleaning unit 70 which is disposed at the mounting and removing position is covered by the first right frame 404A, the cleaning unit 70 can be pulled out from the cleaning unit mounting portion 40B rightward and can reach the cleaning position above the first right frame 404A.

In the present embodiment, a rotation amount of the rotary lever 454, that is, a position of the cleaning unit 70 (cleaning position, separation position) can be detected based on the detection of a rotation amount of the pulse plate 802 performed by the first detection sensor 803 using the mounting and removing position (storing position) shown in FIG. 24 as the reference. When the second detection sensor 804 detects the cleaning housing 70H, it is detected that the cleaning unit 70 has reached the cleaning position. When the pair of guide rollers 705 of the cleaning unit 70 is brought into contact with the pair of positioning portions 102S, the rotation of the rotary lever 454 is restricted by the unit fulcrum pin 70P. However, the controller 90 slightly rotates the rotary shaft 451 by controlling the unit driving unit 80 even after the cleaning unit 70 has reached the cleaning position. At this stage of operation, the coil spring 455 is interposed between the rotary lever 454 and the lever support portion 453, and the coil spring 455 is compressed and deformed between the rotary lever 454 and the lever support portion 453. Accordingly, it is possible to prevent (restrict) a rotational force of the lever support portion 453 generated by the unit driving unit 80 from being applied to the rotary lever 454 in a state where the rotation of the rotary lever 454 about the rotary shaft 451 is stopped. As described above, the rotary shaft 451 can be slightly rotated even after the first detection sensor 803 and the second detection sensor 804 detect that the cleaning unit 70 has reached the cleaning position. Accordingly, the difference (error) in a mounting position of the rotary lever 454 in the front-and-rear direction can be absorbed so that the cleaning unit 70 can be disposed at the cleaning position with certainty. As a result, a pressing force of the pressing roller 72 against the resist lower roller 32 can be maintained in a stable manner.

Figure 32A:
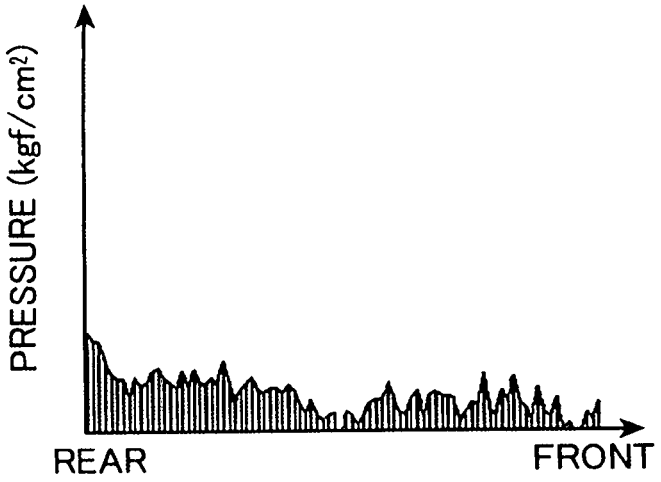
FIGS. 32A, 32B, and 32C are graphs each showing the nip load distribution of the pair of resist rollers.
Figure 32B:
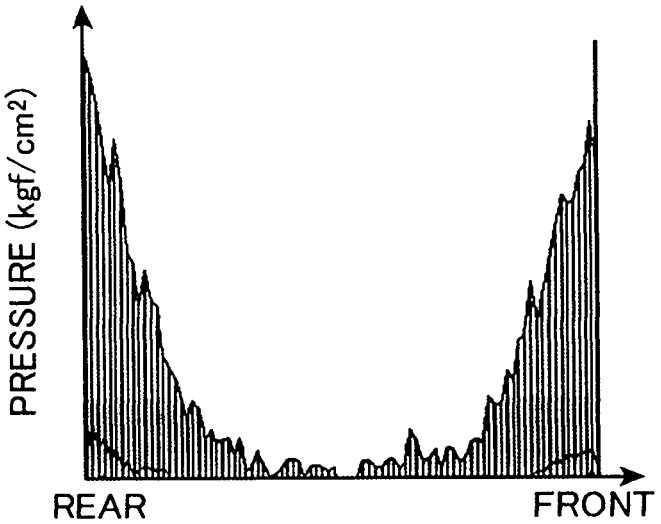
Figure 32C:
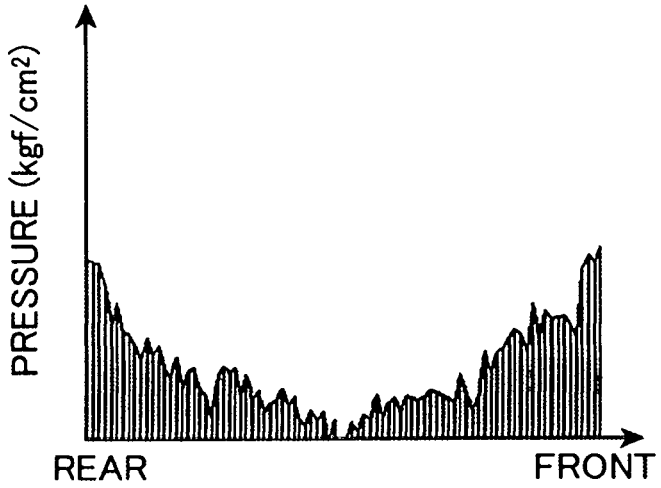
Figure 33:
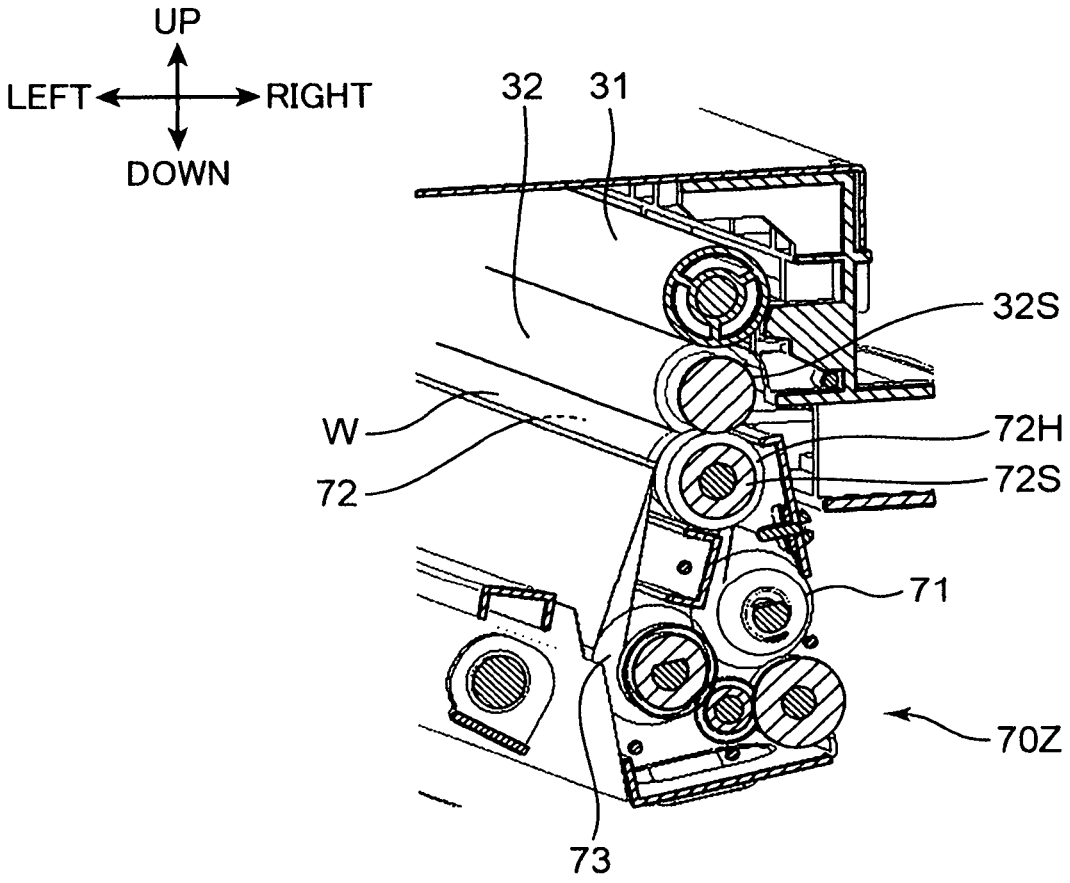
FIG. 33 is a cross-sectional perspective view of another pair of resist rollers and another cleaning unit to be compared with the embodiment of the present disclosure.

FIGS. 32A, 32B, and 32C are graphs each showing the nip load distribution of the pair of resist rollers; and FIG. 33 is a cross-sectional perspective view of another pair of resist rollers and a cleaning unit 70Z to be compared with the present embodiment. FIG. 32A shows the distribution in the axial direction of the nip load (pressure) applied between the resist upper roller 31 and the resist lower roller 32 in a state where the pressing roller 72 is not brought into contact with the resist lower roller 32. On the other hand, FIG. 32B shows the distribution of the same nip load in the configuration shown in FIG. 33. In the cleaning unit 70Z shown in FIG. 33, contact rollers 72H are fixed to both end portions of the pressing roller 72 in the axial direction of the pressing roller shaft 72S. The contact rollers 72H are brought into contact with the shaft 32S of the resist lower roller 32 so as to restrict a distance between axes of the resist lower roller 32 and the pressing roller 72 and, eventually, restrict a pressing force of the pressing roller 72 against the resist lower roller 32. In this manner, in a case where positioning of the pressing roller 72 with respect to the resist lower roller 32 is performed by bringing parts of these rollers into contact with each other, as shown in FIG. 32B, the nip load applied between the resist upper roller 31 and the resist lower roller 32 is liable to be increased at both end portions of the rollers. This phenomenon is caused by a fact that the both end portions of the resist lower roller 32 are strongly pressed to the both end portions of the resist upper roller 31 by a pressing force of the pressing roller 72 against the resist lower roller 32. In this case, the nip loads at both end portions in the axial direction of the pair of resist rollers are excessively large as compared with the nip load at the central portion. Accordingly, the difference occurs in a conveyance speed of the sheet S in the axial direction so that wrinkles are liable to occur on the sheet S.

On the other hand, in the present embodiment, as shown in FIG. 31, the position of the pressing roller 72 with respect to the resist lower roller 32 is restricted by allowing the positioning portions 102S provided at positions different from the resist lower roller 32 to receive the unit fulcrum pins 70P of the cleaning unit 70. As a result, as shown in FIG. 32C, the increase of the nip load of the pair of resist rollers is suppressed as compared with the cleaning unit 70Z and hence, the conveyance of the sheet by the pair of resist rollers is realized in a stable manner.

In the present embodiment, a cleaning operation of the resist lower roller 32 is performed by the cleaning unit 70 when the image forming apparatus 1 performs both-side printing. A sheet S on which an image is formed on the front surface in the both-side printing operation, as described previously, passes the sheet reversing unit 15 and the third conveyance path 13, and is conveyed to the resist roller unit 30 again in a state where the front surface and the back surface of the sheet S are reversed. At this stage of the operation, when ink of the image formed on the front surface adheres to a surface of a PFA tube of the resist lower roller 32, the ink adheres to a distal end portion of the next sheet S from the resist lower roller 32, and the sheet is stained. Further, when the ink adhering to the resist lower roller 32 is transferred to the resist upper roller 31, the ink adheres to a front surface of the next sheet S so that an image defect occurs in a printed image. In view of the above, in the present embodiment, when a back surface of the sheet S passes through the resist lower roller 32 at the time of performing both-side printing, ink adhering to the resist lower roller 32 is cleaned by the web W of the cleaning unit 70. Accordingly, the controller 90 disposes the cleaning unit 70 at the cleaning position corresponding to the execution of both-side printing, and disposes the cleaning unit 70 at the separation position at the time of performing one-side printing. As a result, the web roll WR having a limited length can perform cleaning of the resist lower roller 32 for a long time, and the web roll WR can be made compact and hence, a size of the cleaning device 7 can be made small.

Further, when an image is formed under a condition that the surface of the resist lower roller 32 is minimally stained such as one-side printing, the cleaning unit 70 is disposed at the separation position. Accordingly, a load imposed on the resist lower roller 32 generated by contacting of the cleaning part 70A with the resist lower roller 32 can be reduced, and it is possible to suppress unnecessary feeding of the web W.

On the other hand, when it is detected from a detection result of the third detection sensor 813 of the web feed-out mechanism 81 that the web roll WR has been entirely fed out from the web driven roller 71, the controller 90 allows the display unit (not shown) of the image forming apparatus 1 to display an exchange message for requesting an exchange of the cleaning unit 70. When the operator instructs execution of the exchange operation of the cleaning unit 70 at an operation unit (not shown) of the image forming apparatus 1, the controller 90 moves the cleaning unit 70 to the mounting and removing position by controlling the movement mechanism 75. Then, the operator pulls out the conveyance unit frame 40H forward from the body frame 100 of the apparatus body 10, takes out the cleaning unit 70 from the cleaning unit mounting portion 40B of the conveyance unit frame 40H, and mounts a new cleaning unit 70 on the cleaning unit mounting portion 40B of the conveyance unit frame 40H. In the present embodiment, as described previously, a state of the web roll WR which is held by the web driven roller 71 can be visually recognized from the outside of the cleaning unit 70 through the opening portion formed between the side wall 703A and the bottom wall 703B in FIG. 5. Accordingly, when the operator pulls out the conveyance unit frame 40H from the body frame 100 of the apparatus body 10, the operator can visually recognize a remaining amount of the web roll WR of the cleaning unit 70 stored in the conveyance unit frame 40H from a right side of the conveyance unit frame 40H pulled out from the body frame 100. In other words, in the present embodiment, the cleaning unit mounting portion 40B is disposed on a right side portion of the conveyance unit frame 40H such that a right side portion of the cleaning unit 70 where the web roll WR is exposed to the outside of the cleaning housing 70H can be visually recognized.

In the present embodiment, when the cleaning unit 70 is removed from the apparatus body 10 integrally with the conveyance unit frame 40H, a part of the drive transmission system between the rotation drive unit 75K and the pair of rotary levers 454 (the engagement between an apparatus body 10 and the unit drive output gear 805) is disconnected. As a result, the pair of rotary levers 454 becomes rotatable freely about the rotary shaft 451. Accordingly, when the operator removes the old cleaning unit 70 from the cleaning unit mounting portion 40B, the pair of rotary levers 454 can rotate so as to send out the cleaning unit 70 to the outside of the cleaning unit mounting portion 40B. In other words, the pair of rotary levers 454 rotates about the rotary shaft 451 so as to assist the removal of the pair of unit fulcrum pins 70P of the cleaning unit 70 from the pair of pin receiving portions 454P. As a result, the operator can easily remove the pair of unit fulcrum pins 70P of the cleaning unit 70 from the pair of pin receiving portions 454P. As a result, the cleaning unit 70 can be easily removed from the conveyance unit frame 40H of the belt conveyance unit 40.

The cleaning device 7 and the image forming apparatus 1 including the cleaning device 7 according to one embodiment of the present disclosure have been described above. With such configurations, the image forming apparatus 1 can stably form an image while cleaning the surface of the resist lower roller 32 in a stable manner. The present disclosure is not limited to the above embodiment, and the following modified embodiments can be adopted.

In the above-described embodiment, the description has been made with respect to the mode where the cleaning part 70A of the cleaning unit 70 has the web W. However, the cleaning part 70A for cleaning the resist lower roller 32 is not limited to the web W. The cleaning part 70A may include other cleaning members such as a sponge roller or a brush roller which is brought into contact with the resist lower roller 32.

In the above-described embodiment, the description has been made using the resist lower roller 32 as the conveyance roller to be cleaned by the cleaning unit 70. However, the conveyance roller may be another roller which conveys the sheet S.

Further, in the above-described embodiment, the description has been made with respect to the mode where the image forming unit 50 is formed of an ink-jet-type image forming unit. However, the image forming unit 50 may be formed of an image forming unit which adopts another image forming method such as a publicly known electrophotographic method.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A cleaning device capable of cleaning a surface of a conveyance roller that is rotatably supported on an apparatus body of an image forming apparatus and is configured to convey a sheet, the cleaning device comprising:

a cleaning unit including a cleaning part that has a contact surface extending along an axial direction of the conveyance roller and configured to clean the surface of the conveyance roller by bringing the contact surface into contact with the surface of the conveyance roller from below, and a cleaning housing configured to support the cleaning part; and a movement mechanism that is capable of moving the cleaning unit between a cleaning position and a mounting and removing position below the cleaning position, the movement mechanism allowing the cleaning part to be brought into contact with the conveyance roller at the cleaning position, allowing the cleaning part to be disposed below the conveyance roller in a separated manner at the mounting and removing position and allowing the cleaning unit to be mounted on and removed from the apparatus body, wherein the cleaning housing includes:

a pair of wall portions disposed so as to face each other in the axial direction and supporting the cleaning part; and a pair of housing shaft portions that is formed on the pair of wall portions in a protruding manner in the axial direction from outer surfaces of the pair of wall portions, the movement mechanism includes:

a unit housing portion that houses the cleaning unit disposed at the mounting and removing position;

a pair of support members that is disposed in the unit housing portion and is capable of supporting the cleaning housing so as to sandwich the cleaning housing from both sides in the axial direction, the pair of support members each having a shaft support portion that receives the housing shaft portion and supports the housing shaft portion in a rotatable manner;

a rotation drive unit that is disposed above the shaft support portion and is configured to rotate the pair of support members about a first center axis parallel to the axial direction such that the cleaning unit moves between the cleaning position and the mounting and removing position in a state where the pair of housing shaft portions is pivotally supported on the pair of shaft support portions, the rotation drive unit rotating the pair of support members while allowing the pair of housing shaft portions to be rotated relative to the pair of shaft support portions such that the cleaning unit maintains an orientation where the cleaning part faces upward; and a positioning portion that is configured to be brought into contact with the cleaning unit at the cleaning position and is configured to position the cleaning unit such that the cleaning part is capable of cleaning the conveyance roller, wherein the rotation drive unit includes:

a shaft that extends along the axial direction and forms the first center axis;

a drive unit that generates a rotational drive force for rotating the shaft;

a pair of fixing members that is fixed to the shaft respectively so as to be capable of holding the pair of support members; and a pair of spring members that is disposed so as to be interposed between the pair of support members and the pair of fixing members, the pair of spring members being elastically deformed between the fixing members and the support members so as to suppress a rotational force of the fixing members generated by the drive unit from being applied to the support members when the cleaning unit that has reached the cleaning position is brought into contact with the positioning portion so that rotation of the pair of support members about the first center axis is restricted.

2. The cleaning device according to claim 1, wherein the cleaning housing further includes a pair of guide rollers that is supported by the pair of wall portions above the housing shaft portion respectively, each guide roller including an outer peripheral surface being rotatable about a second center axis parallel to the axial direction, and the movement mechanism further includes a pair of guide portions that is disposed so as to extend in a vertical direction at intervals in the axial direction closer to one end side in a horizontal width direction orthogonal to the axial direction than the cleaning unit disposed at the mounting and removing position is, the pair of guide portions allowing contact of the pair of guide rollers with the pair of guide portions along with the rotation of the pair of support members about the first center axis and guiding the cleaning unit between the cleaning position and the mounting and removing position.

3. The cleaning device according to claim 2, wherein in a state where the cleaning unit is disposed at the mounting and removing position, the pair of support members is disposed so as to extend downward from the first center axis, and the shaft support portion has a shape obtained by cutting out a side portion of the support member on the one end side in the width direction toward the other end side in the width direction opposite to the one end side and downward, and receives the housing shaft portion in a direction orthogonal to the axial direction, and the rotation drive unit moves the cleaning unit to the cleaning position by rotating the pair of support members about the first center axis such that the housing shaft portion moves toward the one end side in the width direction and upward from a state where the cleaning unit is disposed at the mounting and removing position.

4. The cleaning device according to claim 3, wherein when the cleaning unit disposed at the mounting and removing position is viewed in a direction parallel to the axial direction, a center of the housing shaft portion supported by the shaft support portion is disposed below the first center axis and on the one end side in the width direction, and a center of gravity of the cleaning unit is disposed closer to the one end side in the width direction than the housing shaft portion is, and when the rotation drive unit rotates the pair of support members about the first center axis from a state where the cleaning unit is disposed at the mounting and removing position, the cleaning unit tilts toward the one end side in the width direction about the housing shaft portion due to an own weight of the cleaning unit so that the pair of guide rollers is brought into contact with the pair of guide portions respectively.

5. The cleaning device according to claim 4, wherein the cleaning housing includes a connection wall made of a magnetic material and connecting the pair of wall portions to each other along the axial direction, and the unit housing portion includes at least one magnetic member that is disposed so as to face the connection wall of the cleaning housing disposed at the mounting and removing position and generates a magnetic field for holding the cleaning unit.

6. The cleaning device according to claim 5, wherein the connection wall of the cleaning housing is a bottom wall that defines a bottom portion of the cleaning housing, the at least one magnetic member is disposed so as to face the bottom wall of the cleaning unit disposed at the mounting and removing position, and when the cleaning unit disposed at the mounting and removing position is viewed in a direction parallel to the axial direction, a center of the magnetic member in the width direction is disposed closer to the one end side in the width direction than the center of the housing shaft portion supported on the shaft support portion is.

7. The cleaning device according to claim 1, wherein the cleaning part further includes:

a strip-shaped web having a contact surface capable of being brought into contact with the conveyance roller;

a pressing roller configured to press the web to the conveyance roller;

a feed-out roller configured to feed out the web such that a portion of the web that is brought into contact with the conveyance roller changes, and a take-up roller configured to take up the web, and a web drive mechanism that is connected to the cleaning unit disposed at the cleaning position and rotatably drives at least the take-up roller out of the feed-out roller and the take-up roller.

8. The cleaning device according to claim 7, wherein the movement mechanism is capable of moving the cleaning unit to a separation position between the cleaning position and the mounting and removing position in addition to the cleaning position and the mounting and removing position, and when the cleaning unit is disposed at the separation position, the cleaning part is disposed below the conveyance roller in a separated manner, and connection between the cleaning unit and the web drive mechanism is released.

9. An image forming apparatus comprising:

an apparatus body;

a conveyance roller configured to convey a sheet;

an image forming unit configured to form an image on the sheet; and the cleaning device according to claim 1 configured to clean the conveyance roller.

10. The image forming apparatus according to claim 9, further comprising:

a conveyance unit that includes a conveyance portion for conveying the sheet at a position different from the conveyance roller, is mountable on the apparatus body in a first direction parallel to the axial direction, and is removable from the apparatus body in a second direction opposite to the first direction, wherein the unit housing portion is disposed on the conveyance unit, and when the cleaning unit is disposed at the mounting and removing position, the cleaning unit is mountable on and removable from the apparatus body integrally with the conveyance unit.

11. The image forming apparatus according to claim 10, wherein when the cleaning unit is removed from the apparatus body integrally with the conveyance unit, a part of a drive transmission system between the rotation drive unit and the pair of support members is cut so that the pair of support members is rotatable about the first center axis so as to assist removal of the pair of housing shaft portions of the cleaning unit from the pair of shaft support portions.

12. The image forming apparatus according to claim 10, wherein the conveyance unit includes:

a pair of unit frames that is disposed so as to face each other in the axial direction and supports the conveyance portion;

a lower connection frame that connects the pair of unit frames to each other along the axial direction and supports the cleaning unit disposed at the mounting and removing position from below; and an upper connection frame that connects the pair of unit frames to each other along the axial direction above the lower connection frame and defines the unit housing portion between the lower connection frame and the upper connection frame so as to cover at least a portion of the cleaning unit disposed at the mounting and removing position from above, wherein the rotation drive unit rotates the pair of support members about the first center axis such that the cleaning unit reaches the cleaning position above the upper connection frame while being pulled out from the unit housing portion in a horizontal direction orthogonal to the axial direction.

13. The image forming apparatus according to claim 9 further comprising:

an upper resist roller configured to convey the sheet toward the image forming unit in accordance with image forming timing in the image forming unit, wherein the conveyance roller forms a lower resist roller that is disposed below the upper resist roller, forms a nip portion at which the sheet passes through between the upper resist roller and the lower resist roller, and conveys the sheet toward the image forming unit in accordance with the image forming timing, and the cleaning device cleans a surface of the lower resist roller.

* * * * *